US005294473A

United States Patent [19]

Kawamoto

[11] Patent Number: 5,294,473

[45] Date of Patent: Mar. 15, 1994

[54] PHOTOGRAPHIC POLYESTER SUPPORT

[75] Inventor: Fumio Kawamoto, Kanagawa, Japan

[73] Assignee: Fuji Photo Film Co., Ltd., Kanagawa, Japan

[21] Appl. No.: 105,627

[22] Filed: Aug. 13, 1993

[30] Foreign Application Priority Data

Aug. 18, 1992 [JP] Japan ..... 4-240122

[51] Int. Cl.[5] ..... G03C 1/76

[52] U.S. Cl. ..... 428/141; 428/409; 428/480; 430/525; 430/533

[58] Field of Search ..... 428/141, 409, 480, 913; 430/523, 533

[56] References Cited

U.S. PATENT DOCUMENTS 4,141,735 2/1979 Schrader et al. ..... 96/75

4,645,731 2/1957 Bayless et al. ..... 430/513

*Primary Examiner*—Jack P. Brammer

*Attorney, Agent, or Firm*—Sughrue, Mion, Zinn, Macpeak & Seas

[57] ABSTRACT

A photographic polyester support is disclosed which hardly curls when heat-treated at a temperature of from 50° C. to the glass transition temperature thereof in the form of a bulk roll, its thickness pattern satisfying the conditions of (1) Max-Min in the whole widthwise direction (TD R value): 8 μm or less, (2) Max-Min of 5 m length in the lengthwise direction (MD R value): 10 μm or less, (3) the difference in thickness between the adjacent hill and hollow (MD fluctuation): 8 μm or less, and (4) the maximum value of hills above a base line of the average thickness of both ends (TD base line value): 5 μm or less. The surface flatness of the heat-treated support is good. When the support is coated with photographic emulsions, the surface of the coated photographic material is even.

13 Claims, 1 Drawing Sheet

PHOTOGRAPHIC POLYESTER SUPPORT

FIELD OF THE INVENTION

The present invention relates to a photographic polyester support which hardly curls and the smoothness of the surface of which is hardly worsened when subjected to heat treatment. An emulsion may be coated thereover with no unevenness.

BACKGROUND OF THE INVENTION

In general, a photographic material is produced by coating at least one photographic layer on a plastic film support. As the plastic film for a photographic support, a cellulosic polymer such as typically triacetyl cellulose (hereinafter referred to as "TAC") and a polyester polymer such as typically polyethylene terephthalate (hereinafter referred to as "PET") are generally employed. Recently, the use of polyethylene naphthalate having higher heat resistance than PET as a photographic support has been investigated.

A photographic material is generally grouped into one of two groups: one being in the form of a sheet film such as an X-ray film, a film for photomechanical processes and a cut film, and the other being in the form of a roll film such as typically a color or black-and-white negative film having a width of 35 m/m or less. The latter is generally housed in a patrone (cartridge) and is charged in a camera for picture-taking.

As a support for a roll film, heretofore, TAC has been used essentially. The characteristics of TAC film as a photographic support are that TAC has no optical anisotropy and has a high transparency and that TAC has an excellent property of easily smoothing the curl of a developed photographic material having it as a support. The excellent property of TAC of easily smoothing the curl of a developed photographic material having it as a support results from the molecular structure of the TAC film itself. Specifically, since a TAC film has a relatively high water-absorbing property, though being a plastic film, because of its characteristic molecular structure, the molecular chain of the film comes to be fluid after the support film of TAC has absorbed water during development of a curled roll film so that the curl of a long-time stored roll film may be smoothed by rearrangement of the molecular chain as fixed in the long-time stored and curled roll film.

If a photographic material having a film support not having an uncurling property is used as a roll film, it would involve problems of having scratches and out-of-focusing during the printing step of forming an image on a photographic paper from the developed roll film and also a problem of jamming during feeding of the roll film.

The use of photographic materials has been diversified widely in these days, and the technology for rapid feeding of a photographic film in a camera or the like during picture-taking with it, elevation of the image magnification and reduction of the size of picture-taking devices has advanced noticeably. Under the advanced technology, the support of photographic materials is needed to have high strength and high dimension stability and to be thin as much as possible.

Since a TAC film has a rigid molecular structure, the film quality of it is brittle. Therefore, at present, use of the film involves various difficult problems.

As opposed to a TAC film, a polyester film has excellent producibility, mechanical strength and dimension stability. Therefore, it has heretofore been considered that such a polyester film would be substitutable for a TAC film.

Since a polyester film strongly curls and the curl of the film remains much when it is rolled, handling of a developed photographic material having a support of the film is troublesome. Therefore, despite the above-mentioned excellent properties, use of the film as a support for a roll film was unfavorable. As a means of overcoming the curling property of the film, U.S. Pat. No. 4,141,735 has proposed heat treatment of the film for reducing the curl of the film. However, if a bulk roll of the film is simply heated on an industrial scale, it would be shrunk, spotted or wrinkled to cause unevenness of an emulsion layer to be coated thereover. Because of this reason, such a heat-treated bulk roll of the film could not be put to practical use.

SUMMARY OF THE INVENTION

An object of the present invention is to provide a photographic polyester support which hardly curls and still has a smooth surface when heat-treated.

This and other objects have been attained by a photographic polyester support which has a thickness pattern satisfying the following conditions:

| | |
|---|---|
| (1) Max-Min in the whole widthwise direction (TD R value): | 8 μm or less |
| (2) Max-Min of 5 m length in the lengthwise direction (MD R value): | 10 μm or less |
| (3) Difference in thickness between the adjacent hill and hollow (MD fluctuation): | 8 μm or less |
| (4) Maximum value of hills above a base line of being the average thickness of the both ends (TD base line value): | 5 μm or less. |

That is, the present invention is directed to a photographic polyester support which has a thickness pattern having a TD R value, an MD R value, an MD fluctuation and a TD base line value as follows:

| | |
|---|---|
| (1) TD R value: | 8 μm or less |
| (2) MD R value: | 10 μm or less |
| (3) MD fluctuation: | 8 μm or less |
| (4) TD base line value: | 5 μm or less. |

By satisfying the above conditions, the polyester support hardly curls when heat-treated at a temperature of from 50° C. to the glass transition temperature thereof in the form of a bulk roll.

BRIEF EXPLANATION OF THE DRAWING

The drawing is an explanatory view explaining the conditions of the thickness pattern of a photographic polyester film of the present invention.

DETAILED DESCRIPTION OF THE INVENTION

Figure 1:
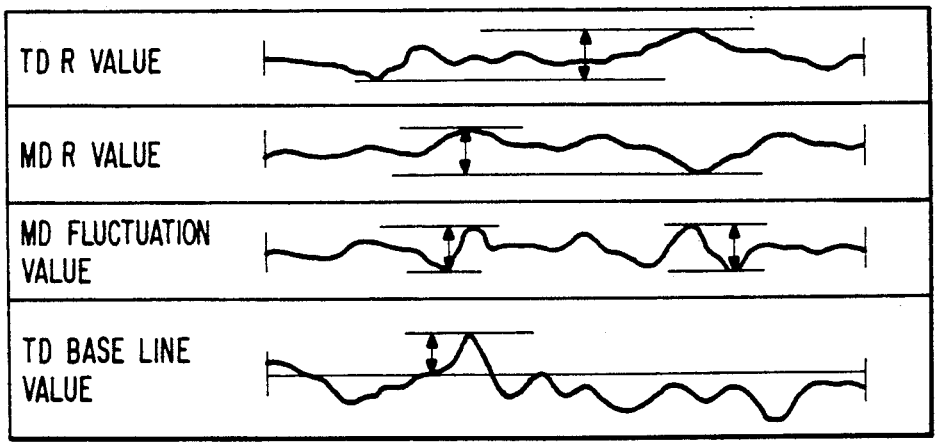

A thickness pattern is a set of the following conditions:

(1) TD R value, (2) MD R value, (3) MD fluctuation, (4) TD base line value, in which TD means a transverse direction, MD means a machine direction, and R means a range, all of which are defined below for present invention.

The technical meanings of the conditions (1) to (4) are analyzed in the figure. The condition (1) is directed to a so-called TD R value of 8 μm or less, preferably 4 μm or less, which is obtained by subtracting the minimum height Min from the maximum height Max in the whole widthwise direction on the surface of a photographic polyester film support. The condition (2) is directed to a so-called MD R value of 10 μm or less, preferably 5 μm or less, which is obtained by subtracting the minimum height Min from the maximum height Max in the range of a length of 5 m in the lengthwise direction on the surface of the same. The condition (3) is directed to a so-called MD fluctuation of 8 μm or less, preferably 4 μm or less, which corresponds to the difference in the thickness between the adjacent hill and hollow of the same support irrespective of the widthwise direction and the lengthwise direction. The condition (4) is directed to a so-called TD base line value of 5 μm or less, preferably 3 μm or less, which corresponds to the maximum value of hills above a base line of the average thickness of both ends of the same support.

From the conditions (1) to (4), the surface of the photographic support is extremely smooth and the thickness thereof is extremely uniform. When heat-treated, the support does not curl and the surface thereof is extremely smooth. When the heat-treated support is coated with an emulsion, it is free from coating unevenness. Thus, the support satisfying the conditions (1) to (4) has extremely excellent properties.

The thickness of a base of the photographic support is varied, depending on the ejecting pressure of its melt, the viscosity of its melt, etc. Then, the thickness is measured to adjust a lip clearance. The controlling of the thickness is conducted by feeding back the obtained data to an extruding portion.

The photographic polyester support of the present invention is made of a polymer obtained by polycondensation of a dibasic carboxylic acid or its ester derivative and a glycol consisting essentially ethylene glycol. Any other polymers and additives may be added thereto, or two or more dibasic acids and two or more glycols may be copolymerized, or two or more polyesters may be blended, provided that such does not detract from the transparency, dimension stability and mechanical strength of the film.

Polyesters for use in the present invention are composed of a diol and a dicarboxylic acid. For instance, such polyesters may be obtained by polymerizing a dicarboxylic acid such as 2,6-naphthalenedicarboxylic acid (NDCA), terephthalic acid (TPA), isophthalic acid (IPA), orthophthalic acid (OPA), cyclohexanedicarboxylic acid (CHDC) or paraphenylenedicarboxylic acid (PPDC) and a diol such as ethylene glycol (EG), cyclohexane dimethanol (CHDM), neopentyl glycol (NPG), bisphenol A (BPA) or biphenol (BP) and optionally also a hydroxycarboxylic acid such as parahydroxybenzoic acid (PHBA) or 6-hydroxy-2-naphthalene-carboxylic acid (HNCA).

Of them, preferred are homopolymers or copolymers of naphthalene-dicarboxylic acid, terephthalic acid and ethylene glycol (in which the molar ratio of naphthalene-dicarboxylic acid to terephthalic acid is preferably from 0.3/0.7 to 1.0/0, more preferably from 0.5/0.5 to 0.8/0.2); homopolymers or copolymers of terephthalic acid, ethylene glycol and bisphenol A (in which the molar ratio of ethylene glycol to bisphenol A is preferably from 0.6/0.4 to 0/1.0, more preferably 0.5/0.5 to 0.1/0.9); homopolymers or copolymers of isophthalic acid, paraphenylene-dicarboxylic acid, terephthalic acid and ethylene glycol (in which the molar ratio of isophthalic acid to terephthalic acid and that of paraphenylene-dicarboxylic acid to the same are preferably from 0.1/1 to 10.0/1 and from 0.1/1 to 20/1, respectively, more preferably from 0.2/1 to 5.0/1 and from 0.2/1 to 10.0/1, respectively); homopolymers or copolymers of naphthalene-dicarboxylic acid, neopentyl glycol and ethylene glycol (in which the molar ratio of neopentyl glycol to ethylene glycol is preferably from 1/0 to 0.7/0.3, more preferably from 0.9/0.1 to 0.6/0.4); homopolymers or copolymers of terephthalic acid, ethylene glycol and biphenol (in which the molar ratio of ethylene glycol to biphenol is preferably from 0/1.0 to 0.8/0.2, more preferably from 0.1/0.9 to 0.7/0.3); and homopolymers or copolymers of parahydroxybenzoic acid, ethylene glycol and terephthalic acid (in which the molar ratio of parahydroxybenzoic acid to ethylene glycol is preferably from 1/0 to 0.1/0.9, more preferably from 0.9/0.1 to 0.2/0.8). Also suitable are polymer blends of, for example, PEN and PET (in which the ratio of the two is preferably from 0.3/0.7 to 1.0/0, more preferably from 0.5/0.5 to 0.8/0.2); and PET and PAr (in which the ratio of the two is preferably from 0.6/0.4 to 0/1.0, more preferably from 0.5/0.5 to 0.1/0.9).

Other dibasic acids of polyester components include phthalic anhydride, succinic acid, glutaric acid, adipic acid, sebacic acid, succinic anhydride, maleic acid, fumaric acid, maleic anhydride, itaconic acid, citraconic anhydride, tetrahydrophthalic anhydride, diphenylene-p,p'-dicarboxylic acid, tetrachlorophthalic anhydride, 3,6-endomethylene-tetrahydrophthalic anhydride, 1,4-cyclohexanedicarboxylic acid, and the following dibasic acids:

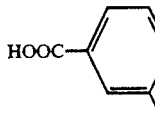

(X: halogen atom),

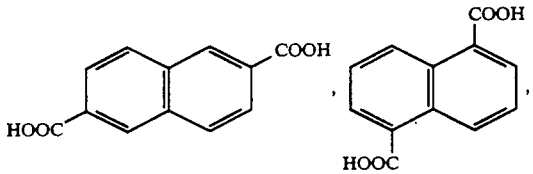

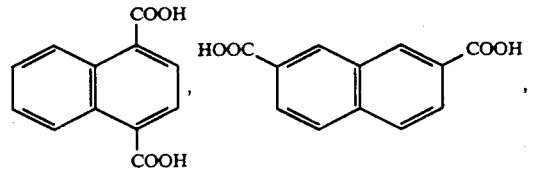

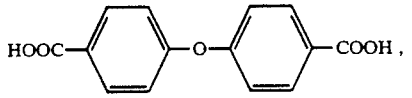

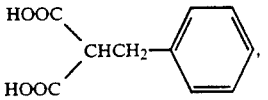

-continued

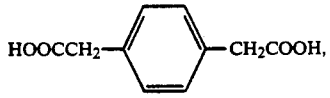

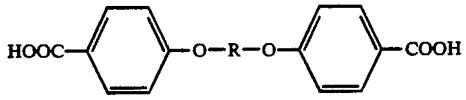

(R: $C_1 \sim C_5$ alkylene),

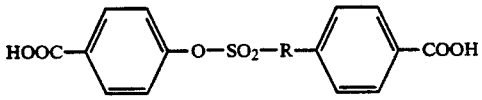

(R: $C_1 \sim C_5$ alkylene),

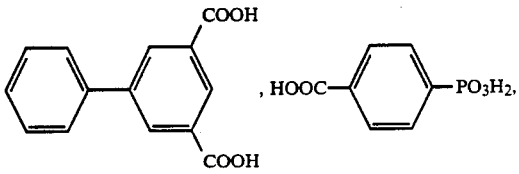

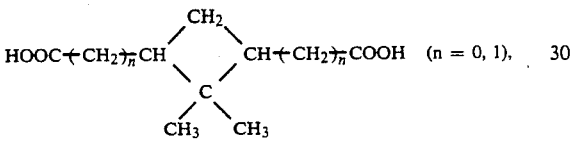

$HOOC-R-SO_2R-COOH$ (R: $C_3 \sim C_5$ alkylene),

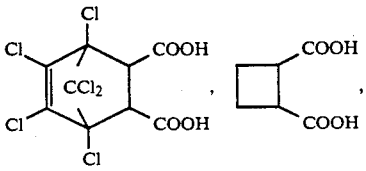

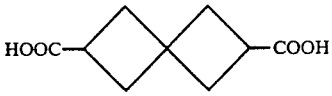

Other diols include 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,3-cyclohexanediol, 1,1-cyclohexane-dimethanol, catechol, resorcinol, hydroquinone, 1,4-benzene-dimethanol and the following diols:

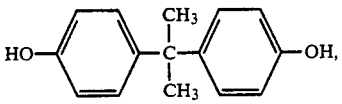

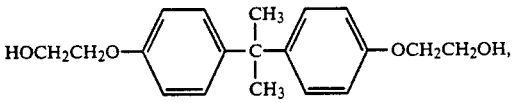

-continued

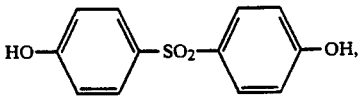

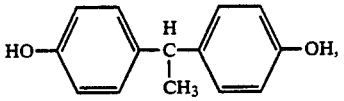

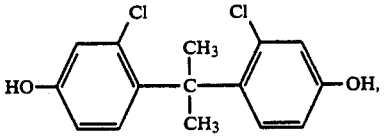

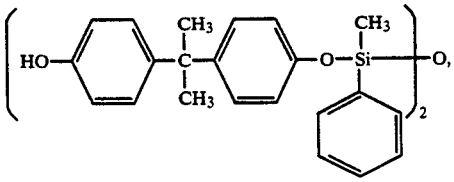

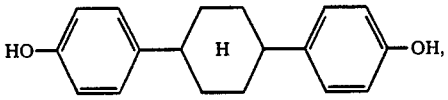

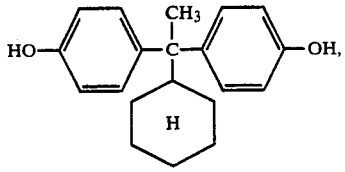

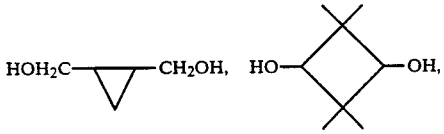

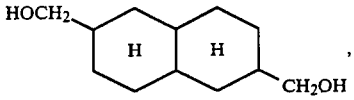

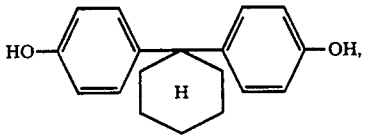

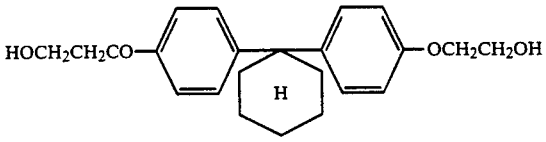

If desired, copolyesters containing additional comonomers of mono-functional or tri- or more polyfunctional hydroxyl group-containing compounds or acid-containing compounds may also be used in the present invention.

Also suitable in the present invention are copolyesters containing additional comonomers of compounds having both hydroxyl group(s) and carboxyl (or its ester) group(s) in the molecule.

Examples of such comonomers include the following compounds:

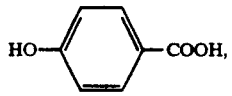

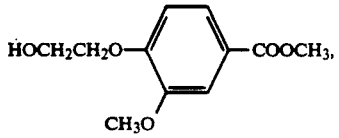

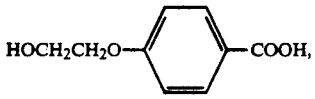

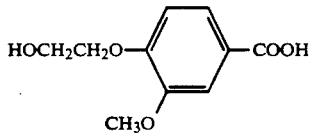

Preferred examples of polyesters for use in the present invention are mentioned below:

| | | |
|---|---|---|
| Homopolymers: | | |
| PEN: | [2,6-naphthalene-dicarboxylic acid (NDCA)/ethylene glycol (EG) (100/100)] | Tg = 119° C. |
| PCT: | [terephthalic acid (TPA)/cyclohexane dimethanol (CHDM) (100/100)] | Tg = 93° C. |
| PAr: | [TPA/bisphenol A (BPA) (100/100)] | Tg = 192° C. |
| Copolymers (the parenthesized ratio is by mol): | | |
| PBC-1: | 2,6-NDCA/TPA/EG (50/50/100) | Tg = 92° C. |
| PBC-2: | 2,6-NDCA/TPA/EG (75/25/100) | Tg = 102° C. |
| PBC-3: | 2,6-NDCA/TPA/EG/BPA (50/50/75/25) | Tg = 112° C. |
| PBC-4: | TPA/EG/BPA (100/50/50) | Tg = 105° C. |
| PBC-5: | TPA/EG/BPA (100/25/75) | Tg = 135° C. |
| PBC-6: | TPA/EG/CHDM/BPA (100/25/25/50) | Tg = 115° C. |
| PBC-7: | IPA/PPDC/TPA/EG (20/50/30/100) | Tg = 95° C. |
| PBC-8: | NDCA/NPG/EG (100/70/30) | Tg = 105° C. |
| PBC-9: | TPA/EG/BP (100/20/80) | Tg = 115° C. |
| PBC-10: | PHBA/EG/TPA (200/100/100) | Tg = 125° C. |
| Polymer Blends (the parenthesized ratio is by weight): | | |
| PBB-1: | PEN/PET (60/40) | Tg = 95° C. |
| PBB-2: | PEN/PET (80/20) | Tg = 104° C. |
| PBB-3: | PAr/PEN (50/50) | Tg = 142° C. |
| PBB-4: | PAr/PCT (50/50) | Tg = 118° C. |
| PBB-5: | PAr/PET (60/40) | Tg = 101° C. |
| PBB-6: | PEN/PET/PAr (50/25/25) | Tg = 108° C. |

Of the above-mentioned polyesters, PEN (polyethylene 2,6-dinaphthalate) has the most-balanced properties. Specifically, it has a high mechanical strength, especially a high modulus of elasticity, and has a sufficiently high glass transition temperature of about 120° C. However, this polyester has a drawback of being fluorescent. On the other hand, PCT has a high mechanical strength and a high glass transition temperature of about 110° C. However, this polyester has a drawback of being hardly transparent since its crystallization speed is extremely high. PAr has the highest glass transition temperature (190° C.) among them, but it has a drawback of having a lower mechanical strength than PET. Therefore, in order to compensate for the drawbacks, blends of these polymers or copolymers of them may be employed.

These homopolymers and copolymers may be produced by conventional known methods of producing ordinary polyesters. For instance, an acid component and a glycol component are directly esterified; or if a dialkyl ester is used as an acid component, it is first interesterified with a glycol component, and the resulting product is then heated under reduced pressure to remove the excess glycol component. Alternatively, an acid halide is used as an acid component and may be reacted with a glycol component. In the case of interesterification, the addition of a catalyst or polymerization catalyst or the addition of a heat-resistant stabilizer may be employed, if desired. Regarding the polyester producing methods, for example, one can refer to the descriptions of Studies of Polymer Experiments, Vol. 5, "Polycondensation and Addition Polymerization" (published by Kyoritsu Publishing Co., 1980), pp. 103–136; and Synthetic Polymers V (published by Asakura Shoten KK, 1971), pp. 187–286.

In addition, one can also refer to the descriptions of JP-B-48-40414, and JP-A-50-81325, JP-A-50-109715, JP-A-1-287129, JP-A-1-266130, JP-A-1-266133, JP-A-55-115425, JP-A-1-244446 and JP-A-4-93937 (the term "JP-B" as used herein means an "examined Japanese patent publication", and the term "JP-A" as used herein means an "unexamined published Japanese patent application").

The polyesters for use in the present invention preferably have a mean molecular weight of approximately from 10,000 to 500,000.

Polymer blends of such polymers may easily be formed in accordance with the methods described in JP-A-49-5482, JP-A-64-4325, and JP-A-3-192718, and *Research Disclosure* 283739-41, 284779-82 and 294807-14.

The polyesters may be blended with a part of other polyesters or may be copolymerized with comonomers constituting other polyesters or may be copolymerized with unsaturated bond-containing monomers for their radical crosslinking, in order to improve the adhesiveness of them to other polyesters.

The photographic polyester support of the present invention is preferably PET, polyethylene naphthalate, polycyclohexane-dimethanol terephthalate, polyacrylate, and their blends. Of them, especially preferred is polyethylene naphthalate (or polyethylene 2,6-dinaphthalate). The polyester film of the present invention may contain various additives.

Furthermore, it is preferred to use a polyester support which is made of a polyester obtained by reacting 2,6-naphthalene-dicarboxylic acid or dimethyl 2,6-naphthalene-dicarboxylate and a glycol consisting essentially of ethylene glycol.

Use of the polyester film as a support of a photographic material involves one problem about its properties, which is that the support causes light-piping due to its high refractive index.

Polyesters have a high refractive index of from 1.6 to 1.7, while gelatin, which is the essential component of a subbing layer and a photographic emulsion layer to be coated over the polyester base film, has a refractive index of from 1.50 to 1.55. Thus, the ratio of the refractive index of gelatin to that of polyesters is lower than 1, and therefore, where light has been introduced into the film from its edge, it easily reflects on the interface between the base and the emulsion layer. Because of this reason, a polyester film causes a so-called light-piping phenomenon.

For avoiding such a light-piping phenomenon in the present invention, dyes which do not increase the film haze may be added to the film. The dyes to be used for coloring the film for this purpose are not specifically defined. Preferred are gray coloring dyes in view of the general properties of photographic materials. Also preferred are dyes having high heat resistance in the temperature range for forming the polyester film and having excellent compatibility with polyesters. In view of the above-mentioned points, specifically mentioned are commercial dyes such as Mitsubishi Kasei's Diaresin or Nippon Chemical's Kayaset. The coloring density due to the addition of such dyes is needed to be at least 0.01 or more, more preferably 0.03 or more, as a visible color density measured with a Macbeth's color densitometer.

The polymer film of the present invention may contain an ultraviolet absorbent for the purpose of anti-fluorescence and stabilization in storage, by kneading the absorbent into the film. As the ultraviolet absorbent, preferred are those not absorbing visible rays. The amount of the absorbent to be in the polymer film is generally approximately from 0.01% by weight to 20% by weight, preferably approximately from 0.05% by weight to 1.0% by weight. Preferred examples of the ultraviolet absorbent are benzophenone compounds such as 2,4-dihydroxybenzophenone, 2-hydroxy-4-methoxybenzophenone, 2-hydroxy-4-n-octyloxybenzophenone, 4-dodecyloxy-2-hydroxybenzophenone, 2,2',4,4'-tetrahydroxybenzophenone, and 2,2'-dihydroxy-4,4'-dimethoxybenzophenone; benzotriazole compounds such as 2-(2'-hydroxy-5-methylphenyl)benzotriazole, 2-(2'-hydroxy-3',5'-di-t-butylphenyl)benzotriazole, and 2-(2'-hydroxy-3'-di-t-butyl-5'-methylphenyl)benzotriazole; and salicylic acid compounds such as phenyl salicylate and methyl salicylate.

The ultraviolet absorbent may also be added to the subbing layer, backing layer, emulsion layer or antihalation layer constituting the photographic material having the polyester support of the present invention.

The polyester film of the present invention may be treated to be lubricative. The means for making the film lubricative is not specifically defined. For instance, generally employable is a method of kneading an inactive inorganic compound into the film or a method of coating a surfactant over the film. Also employable is a method of precipitating internal grains where grains of catalysts or the like as added during polymerization of polyesters are precipitated out.

Inactive inorganic grains usable for this purpose are, for example, $SiO_2$, $TiO_2$, $BaSO_4$, $CaCO_3$, talc, kaolin and the like. No specific means of making the polyester film lubricative is required. However, since it is important that the support of a photographic material be transparent, the grains to be added to the polyester by the former method are desired to be selectively $SiO_2$ grains which have a refractive index relatively near to that of the polyester film, and the internal grains to be precipitated in the polyester film by the latter method are desired to be selectively those having a relatively small grain size.

Where the polyester film is made lubricative by the grains-kneading means, a method of laminating a functional layer over the film is also preferably employable so as to elevate the transparency of the film significantly. Examples of the method are co-extrusion with plural extruders and feed blocks and also co-extrusion with multi-manifold dies.

For forming a polyester into a polyester film, either a finished polyester may be formed into a film while it is a melt or it may be pelletized and the resulting polyester pellets may be formed into a film. In the latter case, the pellets are desired to be dried prior to being extruded to a film.

For forming the film, melt extrusion or biaxial stretching is preferred. For instance, a polyester is melt-extruded onto a rotary cooling device at a temperature of from the melting point of the polymer to 350° C. to form an amorphous non-crystalline sheet, the sheet is roll-stretched from 3.0 to 3.5 times in the lengthwise direction at 70° to 160° C., preferably at 80° to 130° C. and then tenter-stretched from 2.8 to 4.2 times in the crosswise direction at a temperature higher than the temperature for the lengthwise stretching and at 70° to 150° C., preferably from 80° to 130° C., then it is heat-fixed at a temperature higher than the temperature for the crosswise stretching and lower than 260° C., preferably from 150° to 250° C., then it is subjected to heat-relaxation of from 0.1 to 10%, preferably from 0.5 to 5%, and then it is cooled and reeled up. For the stretching, simultaneous biaxial stretching using tenter clips is also preferred. If desired, the crosswise stretched film may be again lengthwise stretched.

The thickness of the polyester film of the present invention is desired to be from 60 to 90 μm. Measurement of the glass transition temperature and the thickness pattern of the film of the present invention is effected by the methods mentioned below.

Measurement of Glass Transition Temperature Tg

Using a differential scanning colorimeter (DSC), 10 mg of a sample film is heated in a nitrogen stream at a rate of 20° C./min, and a mathematical average temperature of the temperature at which the heated film begins to be shifted from its base line and the temperature at which it comes back to a new base line is obtained.

Measurement of Thickness Pattern

Using an electronic micrometer manufactured by Anritsu Electric Co., the thickness of a sample film is measured at a line speed of 600 mm/min, and the measured data is recorded on a chart sheet with a scale of 1/20 at a chart speed of 30 mm/min. The recorded data are measured with a ruler and rounded off to integers.

The photographic polyester film of the present invention may be knurled. The knurling may be effected by a known method such as that described in JP-B-57-36129. It is preferred that the knurled thickness is thicker than the mean thickness of the bulk roll by 5 to 50 μm.

The polyester film of the present invention may previously be subjected to various surface treatments such as corona-discharging treatment, chemical treatment or flame treatment so as to improve the adhesiveness and the wettable characteristic with coating liquids. Of such surface treatments, most preferred for the film of the present invention is corona-discharging treatment by which precipitation of lower polymers onto the surface of the treated film is little.

The polyester support of the present invention preferably has a subbing layer in order to increase its adhesiveness with the photographic layers such as light-sensitive layers to be coated thereover.

For instance, a subbing layer of a polymer latex such as a styrene-butadienne copolymer or vinylidene chloride copolymer and a subbing layer of a hydrophilic binder such as gelatin can be used.

Of the two, a subbing layer of a hydrophilic binder is preferred for the present invention.

Hydrophilic binders suitable for the present invention include water-soluble polymers, cellulose esters, latex polymers and water-soluble polyesters. The water-soluble polymers include gelatin, gelatin derivatives, casein, agar, sodium alginate, starch, polyvinyl alcohol, polyacrylic acid copolymers and maleic anhydride copolymers, and the cellulose esters include carboxymethyl cellulose and hydroxyethyl cellulose. The latex polymers include vinyl chloride-containing copolymers, vinylidene chloride-containing copolymers, acrylate-containing copolymers, vinyl acetate-containing copolymers and butadiene-containing copolymers. Of them, most preferred is gelatin.

Compounds for swelling the support of the present invention include resorcinol, chlororesorcinol, methyl resorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate. Of them, preferred are resorcinol and p-chlorophenol.

The subbing layer of the present invention may contain various gelatin hardening agents. Suitable gelatin hardening agents are, for example, chromium salts (chromium alum, etc.), aldehydes (formaldehyde, glutaraldehyde, etc.), isocyanates, active halogen compounds (2,4-dichloro-6-hydroxy-s-triazine, etc.), epichlorohydrin resins and others.

The subbing layer of the present invention may contain fine inorganic grains such as $SiO_2$, $TiO_2$ or mat agents or fine grains(having a grain size of from 1 to 10 μm) of polymethyl methacrylate copolymers.

The subbing layer may be coated on the support by any well-known method, for example, by a dip-coating, air knife-coating, curtain-coating, wire bar-coating, gravure-coating or an extrusion coating method.

The photographic material of the present invention may have various non-light-sensitive layers such as an anti-halation layer, interlayer, backing layer and surface protective layer, in addition to light-sensitive layers.

The binder of the backing layer may be made of a hydrophobic polymer or may also be made of a hydrophilic polymer such as that in the subbing layer.

The backing layer of the photographic material of the present invention may contain an antistatic agent, a lubricant, a mat agent, a surfactant, a dye and other additives. The antistatic agent in the backing layer is not specifically defined. For instance, it includes anionic polyelectrolytes of polymers containing carboxylic acids, carboxylic acid salts or sulfonic acid salts, such as those described in JP-A-48-22017, JP-B-46-24159, JP-A-51-30725, JP-A-51-129216 and JP-A-55-95942; and cationic polymers such as those described in JP-A-49-121523, JP-A-48-91165 and JP-B-49-24582. The ionic surfactant in the layer may be either an anionic one or cationic one. For instance, usable compounds as described in JP-A-49-85826, JP-A-49-33630, U.S. Pat. Nos. 2,992,108, 3,206,312, JP-A-48-87826, JP-B-49-11567, JP-B-49-11568 and JP-A-55-70837.

The most preferred antistatic agent to be in the backing layer of the present invention is fine grains of at least one crystalline metal oxide selected from ZnO, $TiO_2$, $SnO_2$, $Al_2O_3$, $In_2O_3$, $SiO_2$, MgO, BaO and $MoO_2$ or a metal composite of them.

The fine grains of the conductive crystalline oxide or composite oxide usable in the present invention have a volume resistivity of $10^7$ Ωcm or less, more preferably $10^5$ Ωcm or less. The grain size of them is desirably from 0.01 to 0.7 μm, especially preferably from 0.02 to 0.5 μm.

Methods of preparing fine particles of conductive crystalline metal oxides or composite oxides to be used in the present invention are described in JP-A-56-143430 and JP-A-60-258541. The first method is such that fine particles of metal oxides are formed by firing and then heat-treated in the presence of hetero atoms so as to improve their conductivity. The second method is such that fine particles of metal oxides are formed by firing in the presence of hetero atoms for improving their conductivity. The third method is such that fine particles of metal oxides are formed by firing in an atmosphere having a lowered oxygen concentration so as to introduce oxygen defects into them. For the introduction of hetero atoms, Al, In or the like to ZnO; Nb, Ta or the like to $TiO_2$; and Sb, Nb, a halogen element or the like to $SnO_2$ can be used. The amount of the hetero atoms to be added is preferably from 0.01 to 30 mol %, more preferably from 0.1 to 10 mol %.

The photographic layers constituting the photographic material of the present invention will now be mentioned. The photographic material of the present invention is most preferably a silver halide photographic material such as silver halide color negative film, color positive film, color reversal film and black-and-white negative film.

The photographic emulsions to be used in the present invention may be prepared by known methods such as those described in P. Glafkides, Chemie et Physique Photographique (published by Paul Montel, 1967); G. F. Duffin, Photographic Emulsion Chemistry (published by The Focal Press, 1966); and V. L. Zelikmann et al., Making and Coating Photographic Emulsion (published by The Focal Press, 1964). For instance, they may be prepared by any of an acid method, a neutral method and an ammonia method. As a system of reacting a soluble silver salt and soluble halide(s) for forming the emulsions, any of a single jet method, a double jet method and a combination of them may be employed.

Also employable is a so-called reversed mixing method where silver halide grains are formed in the presence of excess silver ions. As one system of a double jet method, a so-called controlled double jet method can be used where the pAg value in the liquid phase of forming silver halide grains is kept constant.

According to this method, an emulsion of silver halide grains having a regular crystalline morphology and having an almost uniform grain size distribution may be obtained.

Two or more silver halide emulsions separately prepared may be blended to form a blend emulsion for use in the present invention.

In the step of forming silver halide grains or of ripening the grains, a cadmium salt, a zinc salt, a lead salt, a thallium salt, an iridium salt or its complex, a rhodium salt or its complex, and/or an iron salt or its complex may be added to the reaction system.

As a binder or protective colloid for the photographic emulsions for use in the present invention, gelatin is advantageously used, but any other hydrophilic colloids may also be used.

For instance, various synthetic hydrophilic polymer substances are usable, including proteins such as gelatin derivatives, graft polymers of gelatin and other high polymers, albumin and casein; cellulose derivatives such as hydroxyethyl cellulose, carboxymethyl cellulose and cellulose sulfates; saccharide derivatives such as sodium alginate and starch derivatives; and homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole and polyvinyl pyrazole.

As gelatin, a lime-processed gelatin and an acid-processed gelatin and also an enyzme-processed gelatin such as that described in Bull. Soc. Sci. Phot. Japan, No. 16, page 30 (1966) can be used. In addition, hydrolysates of gelatin and enzyme-decomposed products thereof are also usable. Gelatin derivatives include reaction products obtained by reacting gelatin and various compounds such as acid halides, acid anhydrides, isocyanates, bromoacetic acid, alkanesultones, vinylsulfonamides, maleinimide compounds, polyalkylene oxides and epoxy compounds. Examples of the derivatives are described in, for example, U.S. Pat. Nos. 2,614,928, 3,132,945, 3,186,846, 3,312,553, British Patents 861,414, 1,033,189, 1,005,784, and JP-B-42-26845.

Gelatin graft polymers include reaction products obtained by grafting gelatin with various homopolymers or copolymers of vinyl monomers such as acrylic acid, methacrylic acid, their derivatives such as their esters and amides, acrylonitrile and styrene. Of them, especially preferred are graft polymers of gelatin with polymers which are miscible with gelatin in some degree, such as copolymers of acrylic acid, methacrylic acid, acrylamide, methacrylamide and/or hydroxyalkyl methacrylates. Examples of them are described in, for example, U.S. Pat. Nos. 2,763,625, 2,831,767 and 2,956,884.

Typical synthetic hydrophilic polymer substances usable in the present invention are described in German Patent OLS 2,312,798, U.S. Pat. Nos. 3,620,751 and 3,879,205 and JP-B-43-7561.

The photographic emulsions for use in the present invention may contain various compounds for the purpose of preventing them from fogging and for the purpose of stabilizing their photographic properties during the steps of preparing, storing and processing photographic materials. For instance, they may contain various compounds known as an anti-foggant or stabilizer, for example, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (especially 1-phenyl-5-mercaptotetrazole); mercaptopyrimidines; mercaptotriazines; thioketo compounds such as oxazolinethione; azaindenes such as triazaindenes, tetrazaindenes (especially 4-hydroxy-substituted (1,3,3*a*,7)-tetrazaindenes) and pentazaindenes; and benzenethiosulfonic acids, benzenesulfinic acids, and benzenesulfonic acid amides. For instance, those compounds disclosed in U.S. Pat. No. 3,954,474, U.S. Pat. No. 3,982,947 and JP-B-52-28660 may be used.

The photographic emulsions for use in the present invention may contain, for example, polyalkylene oxides or their derivatives such as ethers, esters, amines, thioether compounds, thiomorpholines, quaternary ammonium salt compounds, urethane derivatives, imidazole derivatives, 3-pyrazolidones, etc. Specifically, the compounds described in U.S. Pat. Nos. 2,400,532, 2,423,549, 2,716,062, 3,617,280, 3,772,021 and 3,808,003 and British Patent 1,488,991 may be used for this purpose.

The photographic emulsion of the present invention may be color-sensitized with methine dyes and others. Usable for the color sensitization are cyanine dyes, merocyanine dyes, complex cyanine dyes, complex merocyanine dyes, holopolar cyanine dyes, hemicyanine dyes, styryl dyes and hemioxonole dyes. Of them, especially usable are cyanine dyes, merocyanine dyes and complex merocyanine dyes. These dyes may have any nuclei which are generally in cyanine dyes as basic heterocyclic nuclei.

Such nuclei include, for example, pyrroline nuclei, oxazoline nuclei, thiazoline nuclei, pyrrole nuclei, oxazole nuclei, thiazole nuclei, selenazole nuclei, imidazole nuclei, tetrazole nuclei and pyridine nuclei; nuclei with alicyclic hydrocarbon rings fused to these nuclei; and nuclei with aromatic hydrocarbon nuclei fused to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei and quinoline nuclei. These nuclei may have substituents on the carbon atoms.

Merocyanine dyes or complex merocyanine dyes for use in the present invention may have 5-membered or 6-membered heterocyclic nuclei such as pyrazolin-5-one nuclei, thiohydantoin nuclei, 2-thioxazolidine-2,4-dione nuclei, thiazolidine-2,4-dione nuclei, rhodanine nuclei and thiobarbituric acid nuclei, as ketomethylene nuclei.

Examples of sensitizing dyes usable in the present invention are described in, for example, German Patent 929,080, U.S. Pat. Nos. 2,231,658, 2,493,748, 2,503,776, 2,519,001, 2,912,329, 3,656,959, 3,672,897, 3,694,217, 4,025,349, 4,046,572, British Patent 1,242,588, and JP-B-44-14030 and JP-B-52-24844.

These sensitizing dyes may be used either singly or in combination thereof. A combination of sensitizing dyes is often employed for the purpose of super-color sensitization. Specific examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, JP-B-43-4936, JP-B-53-12375, JP-A-52-110618 and JP-A-52-109925.

The photographic emulsions of the present invention may contain dyes which themselves have no color-sensitizing activity or substances which do not substantially absorb visible rays but have supercolor-sensitizing activity in combination with sensitizing dyes. For instance, they may contain aminostilbene compounds substituted by nitrogen-containing heterocyclic group(s) (such as those described in U.S. Pat. No. 3,635,721), aromatic organic acid-formaldehyde condensate compounds (such as those described in U.S. Pat. No. 3,743,510), cadmium salts and azaindene compounds. In particular, combinations described in U.S. Pat. Nos. 3,615,613, 3,615,641, 3,617,295 and 3,635,721 are especially useful.

The photographic material of the present invention may contain water-soluble dyes in the hydrophilic colloid layers as filter dyes or for anti-irradiation or for other various purposes. Such dyes include, for example, oxonole dyes, hemioxonole dyes, styryl dyes, merocyanine dyes, cyanine dyes and azo dyes. Of them, oxonole dyes, hemioxonole dyes and merocyanine dyes are useful. Specific examples of usable dyes are described in U.S. Pat. No. 1,177,429, JP-A-48-85130, JP-A-49-99620, JP-A-49-114420, JP-A-52-108115, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,362.

The photographic material of the present invention may contain a brightening agent of stilbene compounds, triazine compounds, oxazole compounds or coumarin compounds in the photographic emulsion layers or in any other hydrophilic colloid layers. The brightening agent may be either soluble or insoluble in water. In the latter case, the agent is in the layers as a dispersion thereof. Specific examples of usable brightening agents are described in, for example, U.S. Pat. Nos. 2,632,701, 3,269,840, 3,359,102, and British Patents 852,075 and 1,319,763.

The photographic material of the present invention may contain known anti-fading agents or color stabilizers, such as those mentioned below, singly or as a mixture of two or more thereof. Known anti-fading agents include hydroquinone derivatives described in U.S. Pat. Nos. 2,360,290, 2,418,613, 2,675,314, 2,701,197, 2,704,713, 2,728,659, 2,732,300, 2,735,765, 2,710,801, 2,816,028, and British Patent 1,363,921; gallic acid derivatives described in U.S. Pat. Nos. 3,457,079 and 3,069,262; p-alkoxyphenols described in U.S. Pat. Nos. 2,735,766, 3,698,909, JP-B-49-20977, and JP-B-52-6623; p-hydroxyphenol derivatives described in U.S. Pat. Nos. 3,432,300, 3,573,050, 3,574,629, 3,764,337, JP-A-52-35633, JP-A-52-147434, and JP-A-52-152225; and bisphenols described in U.S. Pat. No. 3,700,455.

The photographic material of the present invention may contain hydroquinone derivatives, aminophenol derivatives, gallic acid derivatives and ascorbic acid derivatives as a color-fogging inhibitor. Specific examples of them are described in U.S. Pat. Nos. 2,360,290, 2,336,327, 2,403,721, 2,418,613, 2,675,314, 2,701,197, 2,704,713, 2,728,659, 2,732,300, 2,735,766, JP-A-50-92988, JP-A-50-92989, JP-A-50-93928, JP-A-50-110337, JP-A-52-145235 and JP-B-50-23813.

The present invention may be applied to a multi-layer multi-color photographic material having at least two layers each having a different color sensitivity on the support. A multi-layer natural-color photographic material generally has at least one red-sensitive emulsion layer, at least one green-sensitive emulsion layer and at least one blue-sensitive emulsion layer on the support. The order of these layers may be selected freely in accordance with necessity. In general, the red-sensitive emulsion layer contains cyan-forming couplers, the green-sensitive emulsion layer contains magenta-forming couplers, and the blue-sensitive emulsion layer contains yellow-forming couplers. As the case may be, any other different combination may be employed.

The most preferred photographic material of the present invention is a picture-taking color negative film roll.

The color negative film of the present invention may contain any known color couplers.

For instance, it may contain compounds (hereinafter referred to as couplers) capable of reacting with an oxidation product of an aromatic amine (generally, primary amine) developing agent to form a dye. The couplers are desired to be non-diffusive ones containing hydrophobic group(s) in the molecule. The hydrophobic group is called a ballast group. The couplers may be either 4-equivalent ones or 2-equivalent ones to silver ions. It may also contain colored couplers having an effect for color compensation or couplers of releasing a development inhibitor during development (so-called DIR couplers). The couplers may also be those capable of forming a colorless product by a coupling reaction.

Suitable yellow-coloring couplers include known ketomethylene couplers. In particular, benzoylacetanilide compounds and pivaloylacetanilide compounds are advantageous. Specific examples of usable yellow-coloring couplers are described in, for example, U.S. Pat. Nos. 2,875,057, 3,265,506, 3,408,194, 3,551,155, 3,582,322, 3,725,072, 3,891,445, German Patent 1,547,868, German Patent OLS Nos. 2,219,917, 2,261,361, 2,414,006, British Patent 1,425,020, JP-B-51-10783, JP-A-47-26133, JP-A-48-73147, JP-A-51-102636, JP-A-50-6341, JP-A-50-123342, JP-A- 50-130442, JP-A-51-21827, JP-A-50-87650, JP-A-52-82424 and JP-A-52-115219.

Suitable magenta couplers include pyrazolone compounds, indazole compounds and cyanoacetyl compounds. In particular, pyrazolone compounds are advantageous. Specific examples of magenta-coloring couplers are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, German Patent 1,810,464, German Patent OLS Nos. 2,408,665, 2,417,945, 2,418,959, 2,424,467, JP-B-40-6031, JP-A-51-20826, JP-A-52-58922, JP-A-49-129538, JP-A-49-74027, JP-A-50-159336, JP-A-52-42121, JP-A-49-74028, JP-A-50-60233, JP-A-51-26541 and JP-A-53-55122.

Suitable cyan-coloring couplers include phenol compounds and naphthol compounds. Specific examples of them are described in, for example, U.S. Pat. Nos. 2,369,929, 2,434,272, 2,474,293, 2,521,908, 2,895,826, 3,034,892, 3,311,476, 3,458,315, 3,476,663, 3,583,971, 3,591,383, 3,767,411, 4,004,929, German Patent OLS Nos. 2,414,830, 2,454,329, JP-A-48-59838, JP-A-51-26034, JP-A-48-5055, JP-A-51-146828, JP-A-52-69624 and JP-A-52-90932.

Suitable colored couplers include those described in, for example, U.S. Pat. Nos. 3,476,560, 2,521,908, 3,034,892, JP-B-44-2016, JP-B-38-22335, JP-B-42-11304, JP-B- 44-32461, JP-A-51-26034, JP-A-52-42121, and German Patent OLS No. 2,418,959.

Suitable DIR couplers include those described in, for example, U.S. Pat. Nos. 3,227,554, 3,617,291, 3,701,783, 3,790,384, 3,632,345, German Patent OLS Nos. 2,414,006, 2,454,301, 2,454,329, British Patent 953,454, JP-A-52-69624, JP-A-49-122335, and JP-B-51-16141.

The photographic material of the present invention may contain compounds capable of releasing a development inhibitor by development, in addition to DIR compounds. For instance, those described in U.S. Pat. Nos. 3,297,445, 3,379,529, German Patent OLS No. 241,794, JP-A-52-15271 and JP-A-53-9116 can be used.

Two or more different couplers may be in the same layer of the photographic material of the present invention. If desired, the same compound may be in two or more layers of the material.

In general, the couplers may be added to the emulsion layer in an amount of from $2\times10^{-3}$ to $5\times10^{-1}$ mol, preferably from $1\times10^{-2}$ to $5\times10^{-1}$ mol, per mol of silver in the layer.

For introducing the above-mentioned couplers into the silver halide emulsion layers constituting the photographic material of the present invention, known methods such as the method described in U.S. Pat. No. 2,322,027 may be employed. For instance, they are dissolved in alkyl phthalates (e.g., dibutyl phthalates dioctyl phthalate), phosphates (diphenyl phosphate, triphenyl phosphate, tricresyl phosphate, dioctylbutyl phosphate), citrates (e.g., tributyl acetylcitrate), benzoates (e.g., octyl benzoate), alkylamides (e.g., diethyllaurylamide) or fatty acid esters (e.g., dibutoxyethyl succinate, dioctyl azelate), or in an organic solvent having a boiling point of approximately from 30° C. to 150° C., for example, lower alkyl acetates such as ethyl nitrate or butyl acetate, or ethyl propionate, secondary butyl alcohol, methyl isobutyl ketone, β-ethoxyethyl acetate or methyl cellosolve acetate; and then the resulting solutions are dispersed in hydrophilic colloids. The above-mentioned high boiling point organic solvents and low boiling point organic solvents may be mixed to form mixed solvents for dissolving the couplers.

In addition, the dispersing method of JP-B-51-39852 and JP-A-51-59953 using polymers may also be employed.

Where the couplers have acid groups such as a carboxylic acid group or sulfonic acid group, they may be introduced into hydrophilic colloids as their aqueous alkaline solutions.

The photographic material of the present invention may contain ultraviolet absorbents in the hydrophilic colloid layers. For instance, usable are aryl group-substituted benzotriazole compounds (such as those described in U.S. Pat. No. 3,533,794), 4-thiazolidone compounds (such as those described in U.S. Pat. Nos. 3,314,794 and 3,352,681), benzophenone compounds (such as those described in JP-A-46-2784), cinnamate compounds (such as those described in U.S. Pat. Nos. 3,705,805 and 3,707,375), butadiene compounds (such as those described in U.S. Pat. No. 4,045,229) and benzoxazole compounds (such as those described in U.S. Pat. No. 3,700,455). In addition, ultraviolet absorbents described in U.S. Pat. No. 3,499,762 and JP-A-54-48535 may also be used. Ultraviolet absorbing couplers (e.g., α-naphthol cyan dye-forming couplers) and ultraviolet absorbing polymers may also be used. These ultraviolet absorbents may be mordanted in particular layers.

For processing the photographic material of the present invention, any known methods may be employed. Any known processing solutions may be employed for the processing. The processing temperature may be selected from the range of from 18° C. to 50° C. However, it may be a temperature lower than 18° C. or higher than 50° C., if desired. Any of black-and-white photographic processing for forming silver images and color photographic processing for forming color images may be applied to the photographic material, in accordance with the object.

The color developer to be used for processing the photographic material generally comprises an aqueous alkaline solution containing a color developing agent. The color developing agent may be any known general aromatic amine developing agent of, for example, phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline).

In addition, the compounds described in L. F. A. Mason, Photographic Processing Chemistry (published by Focal Press, 1966), pages 226 to 229, and U.S. Pat. Nos. 2,193,015 and 2,592,364 and JP-A-48-64933 may also be used.

The color developer may additionally contain a pH buffer such as alkali metal sulfites, carbonates, borates and phosphates; and a development inhibitor or antifoggant such as bromides, iodides and organic antifoggants. If desired, it may further contain a water softener; a preservative such as hydroxylamine; an organic solvent such as benzyl alcohol and diethylene glycol; a development accelerator such as polyethylene glycol, quaternary ammonium salts and amines; a dye forming coupler; a competing coupler; a foggant such as sodium borohydride; an auxiliary developing agent such as 1-phenyl-3-pyrazolidone; a tackifier; a polycarboxylic acid chelating agent such as those described in U.S. Pat. No. 4,083,723; and an antioxidant such as those described in German Patent OLS 2,622,950.

After being color-developed, the photographic emulsion layers are generally bleached. Bleaching of the layers may be effected simultaneously with or separately from fixation thereof. Bleaching agents for this step include compounds of polyvalent metals such as iron(III), cobalt(III), chromium(IV) and copper(II), peracids, quinones and nitroso compounds. For instance, usable are ferricyanides; bichromates; organic complexes with iron(III) or cobalt(III), for example, complexes of aminopolycarboxylic acids such as ethylenediaminetetraacetic acid, nitrilotriacetic acid and 1,3-diamino-2-propanoltetraacetic acid, or complexes of organic acids such as citric acid, tartaric acid and phosphoric acid; persulfates; permanganates; and nitrosophenol. Above all, a bleaching solution or bleach-fixing solution having a weak oxidizing power and containing sodium ethylenediaminetetraacetato/iron(III) or ammonium ethylenediaminetetraacetato/iron(III) is advantageous, since the couplers of the present invention may form dyes having a high color density. Ethylenediaminetetraacetato/iron(III) complexes are advantageous either in an independent bleaching solution or in a mono-bath bleach-fixing solution.

The bleaching solution or bleach-fixing solution may contain various bleaching accelerators such as those described in U.S. Pat. Nos. 3,042,520 and 3,241,966, JP-B-45-8506 and JP-B-45-8836, thiol compounds such as those described in JP-A-53-65732, and also other various additives.

The photographic polyester film support of the present invention has an extremely good surface flatness, being different from any other conventional film supports. Therefore, even after being heat-treated, it still maintains the good flatness. It is therefore considered that a photographic material having the support is not curled. The reasons have not been clarified theoretically as yet but are merely within the range of presumption. Since the surface flatness of the heat-treated film is good, the photographic layers to be formed by coating emulsions thereon are even and the photographic material having such a flat support and such even emulsion layers may therefore form high-quality images.

Next, the present invention will be explained in more detail by way of the following examples, which, however, are not intended to restrict the scope of the present invention. All parts, percents, ratios and the like are by weight unless otherwise indicated.

EXAMPLE 1

(1) Kinds and Heat-Treatment of Supports (Polyester Films)

Preparation of Bulk Rolls

PEN

To 100 parts by weight of PEN pellet having an intrinsic viscosity of 0.60, was added Diaresin as a dye (a product of Mitsubishi Kasei Corp., hereinafter the same) so as to make an absorbance of the mixture 0.05 at 400 nm, followed by drying at 170° C. for 4 hours. After melting at 300° C., the mixture was stretched 3.1 times in the longthwise direction at 140° C. and stretched 3.5 times in the crosswise direction at 140° C., followed by heat-fixation at 250° C. for 6 seconds.

PEN/PET=1/1

To 50 parts by weight of PEN pellet and 50 parts by weight of PET pellet each having an intrinsic viscosity of 0.60, was added Diaresin as a dye to make an absorbance of the mixture 0.05 at 400 nm, followed by drying at 170° C. for 4 hours. After melting at 300° C., the mixture was stretched 3.1 times in the lengthwise direction at 120° C. and stretched 3.5 times at 120° C. in the crosswise direction, followed by heat-fixation at 250° C. for 6 seconds.

PET

To 100 parts by weight of PET pellet having an intrinsic viscosity of 0.60, was added Diaresin as a dye to make an absorbance of the mixture 0.05 at 400 nm, followed by drying at 170° C. for 4 hours. After melting at 280° C., the mixture was stretched 3.1 times in the lengthwise direction at 100° C. and stretched 3.5 times in the crosswise direction at 100° C., followed by heat-fixation at 240° C. for 6 seconds.

Using these, bulk rolls of various polyester films as shown in Tables 1 to 6 below were prepared, the films each having the thickness pattern as indicated in the tables. The films of Tables 1 to 3 were heat-treated under the conditions as shown in the tables and the surface flatness of the thus heat-treated films was checked as to whether or not the films were wrinkled or ridged. Then, the films were processed in accordance with the following processes (2) and others. The films of Tables 4 to 6 were directly coated with a subbing layer and a backing layer in accordance with the following processes (2) and (3), without being heat-treated, and thereafter heat-treated in accordance with the following process (4).

After the polyester supports were biaxially stretched, the strength of them was insufficient for use as a photographic support when the lengthwise stretching was less than 3 times or more than 3.5 times and when the crosswise stretching was less than 2.8 times or more than 4.2 times. In addition, if the thickness of the support was less than 60 μm the strength of the support was also insufficient.

TABLE 1-1

(without subbing and backing layers)

| | Support | | | Bulk Roll | | Condition for Heat Treatment | |
|---|---|---|---|---|---|---|---|
| No. | Kind | Glass Transition Point (°C.) | Thickness (μm) | Length (m) | Width (m) | Temp. (°C.) | Time (hr) |
| 1 (sample of the invention | PEN | 120 | 75 | 3500 | 1.5 | 110 | 48 |
| 2 (sample of the invention) | PEN | 120 | 75 | 3500 | 1.5 | 110 | 24 |
| 3 (sample of the invention) | PEN | 120 | 75 | 3500 | 1.5 | 110 | 120 |
| 4 (sample of the invention) | PEN | 120 | 75 | 3500 | 1.5 | 100 | 240 |
| 5 (sample of the invention) | PEN | 120 | 75 | 3500 | 1 | 110 | 48 |
| 6 (sample of the invention) | PEN | 120 | 75 | 5000 | 1.5 | 10 | 48 |
| 7 (sample of the invention) | PEN | 120 | 85 | 3500 | 1.5 | 110 | 48 |
| 8 (sample of the invention) | PEN/PET = 1/1 | 100 | 75 | 3500 | 1.5 | 90 | 48 |
| 9 (sample of the invention) | PET | 80 | 75 | 3500 | 1.5 | 65 | 48 |

TABLE 1-2

(without subbing and backing layers)

| | Thickness Pattern | | | | | | | |
|---|---|---|---|---|---|---|---|---|
| | TD R | MD R | MD | TD Base Line | Knurling | | Surface Flatness | Unevenness |
| No. | Value (μm) | Value (μm) | Fluctuation Value (μm) | Value (μm) | Thickness (μm) | Width (mm) | after Heat Treatment | of Emulsion Layer Coated |
| 1 (sample of the invention | 5 | 4 | 5 | 3 | 40 | 15 | Good | No |
| 2 (sample of the invention) | 4 | 4 | 3 | 4 | 40 | 12 | Good | No |
| 3 (sample of the invention) | 4 | 3 | 3 | 2 | 40 | 15 | Good | No |
| 4 (sample of the invention) | 4 | 3 | 3 | 4 | 40 | 15 | Good | No |

TABLE 1-2-continued (without subbing and backing layers)

| No. | Thickness Pattern: TD R Value (μm) | MD R Value (μm) | MD Fluctuation Value (μm) | TD Base Line Value (μm) | Knurling: Thickness (μm) | Knurling: Width (mm) | Surface Flatness after Heat Treatment | Unevenness of Emulsion Layer Coated |
|---|---|---|---|---|---|---|---|---|
| 5 (sample of the invention) | 5 | 4 | 5 | 3 | 40 | 15 | Good | No |
| 6 (sample of the invention) | 4 | 4 | 4 | 3 | 50 | 15 | Good | No |
| 7 (sample of the invention) | 4 | 5 | 3 | 3 | 40 | 15 | Good | No |
| 8 (sample of the invention) | 5 | 9 | 7 | 4 | 40 | 15 | Good | No |
| 9 (sample of the invention) | 5 | 4 | 5 | 3 | 40 | 15 | Good | No |

TABLE 2-1

(without subbing and backing layers)

| No. | Support: Kind | Support: Glass Transition Point (°C.) | Support: Thickness (μm) | Bulk Roll: Length (m) | Bulk Roll: Width (m) | Condition for Heat Treatment: Temp. (°C.) | Condition for Heat Treatment: Time (hr) |
|---|---|---|---|---|---|---|---|
| 1 (comparative sample) | PEN | 120 | 75 | 3500 | 1.5 | 110 | 48 |
| 2 (comparative sample) | PEN | 120 | 75 | 3500 | 1.5 | 110 | 48 |
| 3 (comparative sample) | PEN | 120 | 75 | 3500 | 1.5 | 110 | 48 |
| 4 (comparative sample) | PEN | 120 | 75 | 3500 | 1.5 | 110 | 48 |
| 5 (comparative sample) | PEN | 120 | 75 | 5000 | 1.5 | 110 | 48 |
| 6 (comparative sample) | PEN | 120 | 85 | 3500 | 1.5 | 110 | 48 |
| 7 (comparative sample) | PEN/PET = 1/1 | 100 | 75 | 3500 | 1.5 | 90 | 48 |
| 8 (comparative sample) | PEN/PET = 1/1 | 100 | 75 | 3500 | 1.5 | 90 | 48 |

TABLE 2-2

(without subbing and backing layers)

| No. | Thickness Pattern: TD R Value (μm) | MD R Value (μm) | MD Fluctuation Value (μm) | TD Base Line Value (μm) | Knurling: Thickness (μm) | Knurling: Width (mm) | Surface Flatness after Heat Treatment | Unevenness of Emulsion Layer Coated |
|---|---|---|---|---|---|---|---|---|
| 1 (comparative sample) | 10 | 4 | 5 | 3 | 40 | 15 | Bad | Yes |
| 2 (comparative sample) | 5 | 12 | 5 | 3 | 40 | 15 | Bad | Yes |
| 3 (comparative sample) | 5 | 4 | 10 | 3 | 40 | 15 | Bad | Yes |
| 4 (comparative sample) | 5 | 4 | 5 | 7 | 40 | 15 | Bad | Yes |
| 5 (comparative sample) | 9 | 4 | 5 | 3 | 40 | 15 | Bad | Yes |
| 6 (comparative sample) | 5 | 12 | 5 | 3 | 40 | 15 | Bad | Yes |
| 7 (comparative sample) | 10 | 4 | 7 | 3 | 40 | 15 | Bad | Yes |
| 8 (comparative sample) | 5 | 13 | 5 | 4 | 40 | 15 | Bad | Yes |

TABLE 3-1

(without subbing and backing layers)

| No. | Support: Kind | Support: Glass Transition Point (°C.) | Support: Thickness (μm) | Bulk Roll: Length (m) | Bulk Roll: Width (m) | Condition for Heat Treatment: Temp. (°C.) | Condition for Heat Treatment: Time (hr) |
|---|---|---|---|---|---|---|---|
| 9 (comparative sample) | PEN/PET = 1/1 | 100 | 75 | 3500 | 1.5 | 90 | 48 |
| 10 (comparative sample) | PEN/PET = 1/1 | 100 | 75 | 3500 | 1.5 | 90 | 48 |

TABLE 3-1-continued (without subbing and backing layers)

| No. | Support Kind | Support Glass Transition Point (°C.) | Support Thickness (μm) | Bulk Roll Length (m) | Bulk Roll Width (m) | Condition for Heat Treatment Temp. (°C.) | Condition for Heat Treatment Time (hr) |
|---|---|---|---|---|---|---|---|
| 11 (comparative sample) | PEN | 80 | 75 | 3500 | 1.5 | 65 | 48 |
| 12 (comparative sample) | PEN | 80 | 75 | 3500 | 1.5 | 65 | 48 |
| 13 (comparative sample) | PEN | 80 | 75 | 3500 | 1.5 | 65 | 48 |
| 14 (comparative sample) | PEN | 80 | 75 | 3500 | 1.5 | 65 | 48 |

TABLE 3-2

(without subbing and backing layers)

| No. | Thickness Pattern TD R Value (μm) | Thickness Pattern MD R Value (μm) | Thickness Pattern MD Fluctuation Value (μm) | Thickness Pattern TD Base Line Value (μm) | Knurling Thickness (μm) | Knurling Width (mm) | Surface Flatness after Heat Treatment | Unevenness of Emulsion Layer Coated |
|---|---|---|---|---|---|---|---|---|
| 9 (comparative sample) | 4 | 5 | 10 | 4 | 40 | 15 | Bad | Yes |
| 10 (comparative sample) | 4 | 5 | 4 | 7 | 40 | 15 | Bad | Yes |
| 11 (comparative sample) | 11 | 4 | 5 | 2 | 40 | 15 | Bad | Yes |
| 12 (comparative sample) | 3 | 13 | 4 | 3 | 40 | 15 | Bad | Yes |
| 13 (comparative sample) | 4 | 4 | 10 | 3 | 40 | 15 | Bad | Yes |
| 14 (comparative sample) | 4 | 5 | 6 | 8 | 40 | 15 | Bad | Yes |

TABLE 4-1

(with subbing and backing layers)

| No. | Support Kind | Support Glass Transition Point (°C.) | Support Thickness (μm) | Bulk Roll Length (m) | Bulk Roll Width (m) | Condition for Heat Treatment Temp. (°C.) | Condition for Heat Treatment Time (hr) |
|---|---|---|---|---|---|---|---|
| 10 (sample of the invention | PEN | 120 | 75 | 3500 | 1.5 | 110 | 48 |
| 11 (sample of the invention) | PEN | 120 | 75 | 3500 | 1.5 | 110 | 24 |
| 12 (sample of the invention) | PEN | 120 | 75 | 3500 | 1.5 | 110 | 120 |
| 13 (sample of the invention) | PEN | 120 | 75 | 3500 | 1.5 | 110 | 240 |
| 14 (sample of the invention) | PEN | 120 | 75 | 3500 | 1 | 110 | 48 |
| 15 (sample of the invention) | PEN | 120 | 75 | 5000 | 1.5 | 10 | 48 |
| 16 (sample of the invention) | PEN | 120 | 85 | 3500 | 1.5 | 110 | 48 |
| 17 (sample of the invention) | PET/PEN = 1/1 | 100 | 75 | 3500 | 1.5 | 90 | 48 |
| 18 (sample of the invention) | PET | 80 | 75 | 3500 | 1.5 | 65 | 48 |

TABLE 4-2

(with subbing and backing layers)

| No. | Thickness Pattern TD R Value (μm) | Thickness Pattern MD R Value (μm) | Thickness Pattern MD Fluctuation Value (μm) | Thickness Pattern TD Base Line Value (μm) | Knurling Thickness (μm) | Knurling Width (mm) | Surface Flatness after Heat Treatment | Unevenness of Emulsion Layer Coated |
|---|---|---|---|---|---|---|---|---|
| 10 (sample of the invention | 6 | 5 | 5 | 4 | 30 | 15 | Good | No |
| 11 (sample of the invention) | 6 | 4 | 5 | 5 | 30 | 12 | Good | No |
| 12 (sample of the invention) | 4 | 3 | 2 | 5 | 30 | 15 | Good | No |
| 13 (sample of the invention) | 5 | 5 | 3 | 4 | 30 | 15 | Good | No |
| 14 (sample of the | 4 | 4 | 5 | 4 | 30 | 15 | Good | No |

TABLE 4-2-continued (with subbing and backing layers)

| No. | Thickness Pattern: TD R Value (μm) | MD R Value (μm) | MD Fluctuation Value (μm) | TD Base Line Value (μm) | Knurling: Thickness (μm) | Knurling: Width (mm) | Surface Flatness after Heat Treatment | Unevenness of Emulsion Layer Coated |
|---|---|---|---|---|---|---|---|---|
| invention) | | | | | | | | |
| 15 (sample of the invention) | 3 | 3 | 4 | 3 | 10 | 15 | Good | No |
| 16 (sample of the invention) | 5 | 5 | 3 | 2 | 30 | 15 | Good | No |
| 17 (sample of the invention) | 6 | 9 | 7 | 4 | 30 | 15 | Good | No |
| 18 (sample of the invention) | 5 | 4 | 8 | 5 | 30 | 15 | Good | No |

TABLE 5-1

(with subbing and backing layers)

| No. | Support: Kind | Support: Glass Transition Point (°C.) | Support: Thickness (μm) | Bulk Roll: Length (m) | Bulk Roll: Width (m) | Condition for Heat Treatment: Temp. (°C.) | Condition for Heat Treatment: Time (hr) |
|---|---|---|---|---|---|---|---|
| 15 (comparative sample) | PEN | 120 | 75 | 3500 | 1.5 | 110 | 48 |
| 16 (comparative sample) | PEN | 120 | 75 | 3500 | 1.5 | 110 | 48 |
| 17 (comparative sample) | PEN | 120 | 75 | 3500 | 1.5 | 110 | 48 |
| 18 (comparative sample) | PEN | 120 | 75 | 3500 | 1.5 | 110 | 48 |
| 19 (comparative sample) | PEN | 120 | 75 | 5000 | 1.5 | 110 | 48 |
| 20 (comparative sample) | PEN | 120 | 85 | 3500 | 1.5 | 110 | 48 |
| 21 (comparative sample) | PEN/PET = 1/1 | 100 | 75 | 3500 | 1.5 | 90 | 48 |
| 22 (comparative sample) | PEN/PET = 1/1 | 100 | 75 | 3500 | 1.5 | 90 | 48 |

TABLE 5-2

(with subbing and backing layers)

| No. | Thickness Pattern: TD R Value (μm) | MD R Value (μm) | MD Fluctuation Value (μm) | TD Base Line Value (μm) | Knurling: Thickness (μm) | Knurling: Width (mm) | Surface Flatness after Heat Treatment | Unevenness of Emulsion Layer Coated |
|---|---|---|---|---|---|---|---|---|
| 15 (comparative sample) | 10 | 5 | 5 | 4 | 30 | 15 | Bad | Yes |
| 16 (comparative sample) | 6 | 12 | 5 | 5 | 30 | 15 | Bad | Yes |
| 17 (comparative sample) | 4 | 3 | 10 | 3 | 30 | 15 | Bad | Yes |
| 18 (comparative sample) | 4 | 4 | 3 | 7 | 30 | 15 | Bad | Yes |
| 19 (comparative sample) | 9 | 5 | 5 | 3 | 30 | 15 | Bad | Yes |
| 20 (comparative sample) | 6 | 12 | 5 | 4 | 30 | 15 | Bad | Yes |
| 21 (comparative sample) | 10 | 4 | 6 | 4 | 30 | 15 | Bad | Yes |
| 22 (comparative sample) | 4 | 13 | 3 | 4 | 30 | 15 | Bad | Yes |

TABLE 6-1

(with subbing and backing layers)

| No. | Support: Kind | Support: Glass Transition Point (°C.) | Support: Thickness (μm) | Bulk Roll: Length (m) | Bulk Roll: Width (m) | Condition for Heat Treatment: Temp. (°C.) | Condition for Heat Treatment: Time (hr) |
|---|---|---|---|---|---|---|---|
| 23 (comparative sample) | PEN/PET = 1/1 | 100 | 75 | 3500 | 1.5 | 90 | 48 |
| 24 (comparative sample) | PEN/PET = 1/1 | 100 | 75 | 3500 | 1.5 | 90 | 48 |
| 25 (comparative sample) | PEN | 80 | 75 | 3500 | 1.5 | 65 | 48 |

TABLE 6-1-continued (with subbing and backing layers)

| No. | Support Kind | Support Glass Transition Point (°C.) | Support Thickness (μm) | Bulk Roll Length (m) | Bulk Roll Width (m) | Condition for Heat Treatment Temp. (°C.) | Condition for Heat Treatment Time (hr) |
|---|---|---|---|---|---|---|---|
| 26 (comparative sample) | PEN | 80 | 75 | 3500 | 1.5 | 65 | 48 |
| 27 (comparative sample) | PEN | 80 | 75 | 3500 | 1.5 | 65 | 48 |
| 28 (comparative sample) | PEN | 80 | 75 | 3500 | 1.5 | 65 | 48 |

TABLE 6-2

(with subbing and backing layers)

| No. | Thickness Pattern TD R Value (μm) | Thickness Pattern MD R Value (μm) | Thickness Pattern MD Fluctuation Value (μm) | Thickness Pattern TD Base Line Value (μm) | Knurling Thickness (μm) | Knurling Width (mm) | Surface Flatness after Heat Treatment | Unevenness of Emulsion Layer Coated |
|---|---|---|---|---|---|---|---|---|
| 23 (comparative sample) | 4 | 5 | 10 | 4 | 30 | 15 | Bad | Yes |
| 24 (comparative sample) | 5 | 5 | 4 | 7 | 30 | 15 | Bad | Yes |
| 25 (comparative sample) | 11 | 3 | 4 | 3 | 30 | 15 | Bad | Yes |
| 26 (comparative sample) | 4 | 13 | 5 | 4 | 30 | 15 | Bad | Yes |
| 27 (comparative sample) | 2 | 5 | 10 | 3 | 30 | 15 | Bad | Yes |
| 28 (comparative sample) | 5 | 5 | 5 | 8 | 30 | 15 | Bad | Yes |

(2) Coating of Subbing Layer

Each support sample was subjected to corona discharging on both surfaces, and the coating liquid described below was coated over one surface to form a subbing layer thereon. For the corona discharging, a solid state corona-discharging machine 6KVA Model (manufactured by Pillar) was used, and the 30 cm-wide support was treated at a speed of 20 m/min. From the current and voltage values as read out, the strength treating the support was 0.375 KV.A.min/$m^2$. The discharging frequency for the treatment was 9.6 KHz, and the gap clearance between the electrode and the dielectric roll was 1.6 mm.

| Composition of Subbing Layer: | |
|---|---|
| Gelatin | 3 g |
| Distilled Water | 250 cc |
| Sodium α-sulfo-di-2-ethylhexyl Succinate | 0.05 g |
| Formaldehyde | 0.02 g |

(3) Coating of Backing Layer

After the subbing layer was coated on one surface of each support sample, a backing layer having the composition described below was coated on the other surface thereof.

(3-1) Preparation of Dispersion of Fine Conductive Grains (Dispersion of Tin Oxide-Antimony Oxide Composite)

230 parts by weight of stannic chloride hydrate and 23 parts by weight of antimony trichloride were dissolved in 3000 parts by weight of ethanol to obtain a uniform solution. 1 N aqueous sodium hydroxide solution was dropwise added to the uniform solution until the latter had pH of 3, whereby co-precipitates of colloidal stannic oxide and antimony oxide were formed. The co-precipitates thus formed were allowed to stand at 50° C. for 24 hours to obtain reddish brown colloidal precipitates.

The reddish brown colloidal precipitates were separated by centrifugation. In order to remove the excess ions, water was added to the co-precipitates for washing them by centrifugation. The operation was repeated three times whereby the excess ions were removed from the co-precipitates.

200 parts by weight of the colloidal precipitates from which the excess ions had been removed were again dispersed in 1500 parts by weight of water, and the resulting dispersion was sprayed into a firing furnace of 600° C. to obtain a bluish powder of fine grains of a tin oxide-antimony oxide composite having a mean grain size of 0.2 μm. The specific resistivity of the fine powdery grains was 25 Ω.cm.

A mixed liquid comprising 40 parts by weight of the fine powdery grains and 60 parts by weight of water was adjusted to have a pH of 7.0 and roughly dispersed with a stirrer. This was then further dispersed in a horizontal sand mill (Dyno Mill, trade name by Willya Ibachofenag) until the residence time became 30 minutes.

(3-2) Formation of Backing Layer

The following composition (A) was coated on the support sample and dried at 115° C. for 60 seconds to have a dry thickness of 0.3 μm. In addition, the following coating liquid (B) was coated over the layer and dried at 115° C. for 3 minutes to have a dry thickness of 0.1 μm.

| Composition (A): | |
|---|---|
| Dispersion of Conductive Fine Grains (prepared above) | 10 wt. pts. |

-continued

| | |
|---|---|
| Gelatin | 1 wt. pt. |
| Water | 27 wt. pts. |
| Methanol | 60 wt. pts. |
| Resorcinol | 2 wt. pts. |
| Polyoxyethylene Nonylphenyl Ether | 0.01 wt. pt. |
| Coating Liquid (B): | |
| Cellulose Triacetate | 1 wt. pt. |
| Acetone | 70 wt. pts. |
| Methanol | 15 wt. pts. |
| Dichloromethylene | 10 wt. pts. |
| P-chlorophenol | 4 wt. pts. |

(4) Heat Treatment of Support Sample

The films of Tables 4 to 6 were, after having been coated with the above-mentioned subbing layer and backing layer, heat-treated under the condition as shown in the tables. The heat treatment was effected in such a way that each sample film was wound around a reel core having a diameter of 30 cm with the coated surface facing outward. After the heat treatment, the surface flatness of the sample was checked as to whether or not the sample was wrinkled or ridged. The results are shown in Tables 4 to 6.

(5) Each support sample as treated in the manner described above was coated with plural photographic layers each having the composition described below to form a multi-layer color photographic material sample.

Compositions of Photographic Layers

Essential components constituting the photographic layers are grouped as follows:

ExC: Cyan Coupler
UV: Ultraviolet Absorbent
ExM: Magenta Coupler
HBS: High Boiling Point Organic Solvent
ExY: Yellow Coupler
H: Gelatin Hardening Agent
ExS: Sensitizing Dye The number for each component indicates the amount coated in g/m$^2$. The amount of silver halide coated is represented as the amount of silver therein coated. The amount of sensitizing dye coated is represented as a molar unit to mol of silver halide in the same layer.

| | |
|---|---|
| First Layer: Anti-halation Layer | |
| Black Colloidal Silver | 0.18 as Ag |
| Gelatin | 1.40 |
| ExM-1 | 0.18 |
| ExF-1 | $2.0 \times 10^{-3}$ |
| HBS-1 | 0.20 |
| Second Layer: Interlayer | |
| Emulsion G | 0.065 as Ag |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third Layer: Low-sensitivity Red-sensitive Emulsion Layer | |
| Emulsion A | 0.25 as Ag |
| Emulsion B | 0.25 as Ag |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |

-continued

| | |
|---|---|
| ExC-4 | 0.010 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |
| Fourth Layer: Middle-sensitivity Red-sensitive Emulsion Layer | |
| Emulsion D | 0.70 as Ag |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| Fifth Layer: High-sensitivity Red-sensitive Emulsion Layer | |
| Emulsion E | 1.40 as Ag |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth Layer: Interlayer | |
| Cpd-1 | 0.10 |
| HBS-1 | 0.50 |
| Gelatin | 1.10 |
| Seventh Layer: Low-sensitivity Green-sensitive Emulsion Layer | |
| Emulsion C | 0.35 as Ag |
| ExS-4 | $3.0 \times 10^{-5}$ |
| ExS-5 | $2.1 \times 10^{-4}$ |
| ExS-6 | $8.0 \times 10^{-5}$ |
| ExM-1 | 0.010 |
| ExM-2 | 0.33 |
| ExM-3 | 0.086 |
| Exy-1 | 0.015 |
| HBS-1 | 0.30 |
| HBS-3 | 0.010 |
| Gelatin | 0.73 |
| Eight Layer: Middle-sensitivity Green-sensitivie Emulsion Layer | |
| Emulsion D | 0.80 as Ag |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| Ninth Layer: High-sensitivity Green-sensitive Emulsion Layer | |
| Emulsion E | 1.25 as Ag |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |

-continued

| | |
|---|---|
| Tenth Layer: Yellow Filter Layer | |
| Yellow Colloidal Silver | 0.030 as Ag |
| Cpd-1 | 0.16 |
| HBS-1 | 0.60 |
| Gelatin | 0.60 |
| Eleventh Layer: Low-sensitivity Blue-sensitive Emulsion Layer | |
| Emulsion C | 0.18 as Ag |
| ExS-7 | $8.6 \times 10^{-4}$ |
| ExY-1 | 0.020 |
| ExY-2 | 0.22 |
| EXY-3 | 0.50 |
| ExY-4 | 0.020 |
| HBS-1 | 0.28 |
| Gelatin | 1.10 |
| Twelfth Layer: Middle-sensitivity Blue-sensitive Emulsion Layer | |
| Emulsion D | 0.40 as Ag |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| Thirteenth Layer: High-sensitivity Blue-sensitive Emulsion Layer | |
| Emulsion F | 1.00 as Ag |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth Layer: First Protective Layer | |
| Emulsion G | 0.20 as Ag |
| UV-4 | 0.11 |
| UV-5 | 0.17 |
| HBS-1 | $5.0 \times 10^{-2}$ |
| Gelatin | 1.00 |
| Fifteenth Layer: Second Protective Layer | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition, the respective layers contained any of W-1 through W-3, B-4 through B-6, F-1 through F-17, and iron salt, lead salt, gold salt, platinum salt, iridium salt and rhodium salt, so as to have improved storability, processability, pressure resistance, fungicidal and bactericidal property, antistatic property and coatability.

Structural formulae of the compounds used as well as the emulsions used are shown below.

TABLE 7

| | Mean AgI Content (%) | Mean Grain Size (μm) | Fluctuation Coefficient to Grain Size (%) | Ratio of Diameter/ Thickness | Ratio of Silver Contents [core/inter-layer/shell] (as AgI content %) | Structure and Shape of Grains |
|---|---|---|---|---|---|---|
| Emulsion A | 4.0 | 0.45 | 27 | 1 | [1/3] (13/1) | two-layer structural octahedral grains |
| Emulsion B | 8.9 | 0.70 | 14 | 1 | [3/7] (25/2) | two-layer structural octahedral grains |
| Emulsion C | 2.0 | 0.55 | 25 | 7 | — | uniform structural tabular grains |
| Emulsion D | 9.0 | 0.65 | 25 | 6 | [12/59/29] (0/11/8) | three-layer structural tabular grains |
| Emulsion E | 9.0 | 0.85 | 23 | 5 | [8/59/33] (0/11/8) | three-layer structural tabular grains |
| Emulsion F | 14.5 | 1.25 | 25 | 3 | [37/63] (34/3) | two-layer structural tabular grains |
| Emulsion G | 1.0 | 0.07 | 15 | 1 | — | uniform structural fine grains |

In Table 7 above:

(1) Emulsions A to F had been subjected to reduction sensitization with thiourea dioxide and thiophosphonic acid during formation of the grains, in accordance with the example of JP-A-2-191938;

(2) Emulsions A to F had been subjected to gold sensitization, sulfur sensitization and selenium sensitization in the presence of the color sensitizing dyes to be in the respective light-sensitive layers and sodium thiocyanate, in accordance with the example of JP-A-3-237450;

(3) for preparation of tabular grains, a low molecular gelatin was used in accordance with the example of JP-A-1-158426; and (4) tabular grains and normal crystalline grains having a granular structure were observed to have dislocation lines as described in JP-A-3-237450, with a high-pressure electronic microscope.

Chemical formulae of the compounds used above are mentioned below.

ExC-1

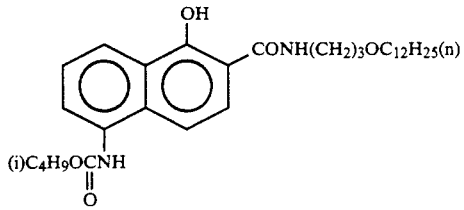

-continued
ExC-2
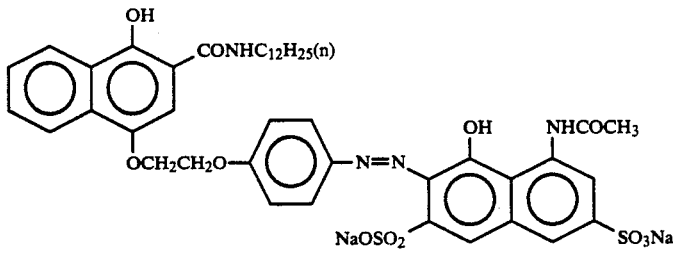
ExC-3
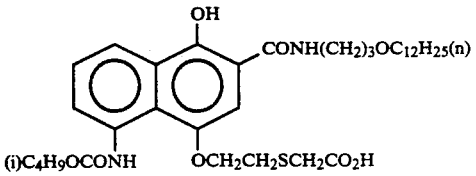
ExC-4
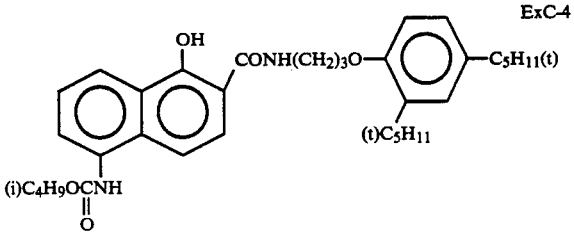
ExC-5
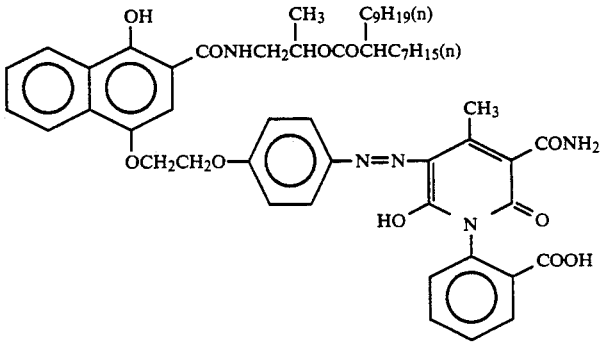
ExC-6
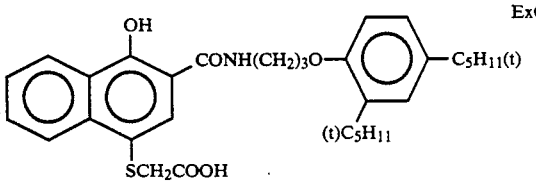
ExC-7
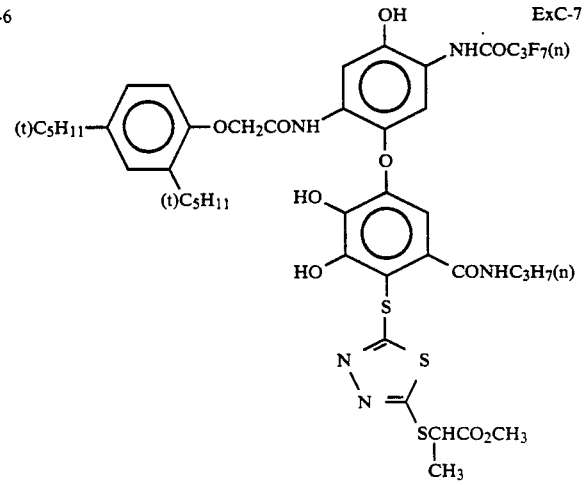

-continued
ExC-8
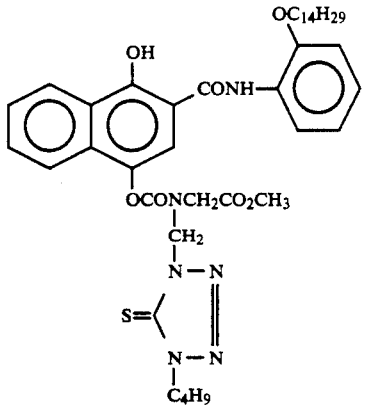
ExM-1
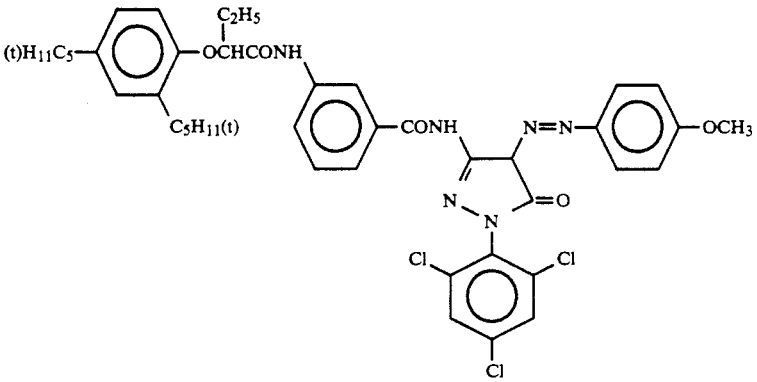
ExM-2
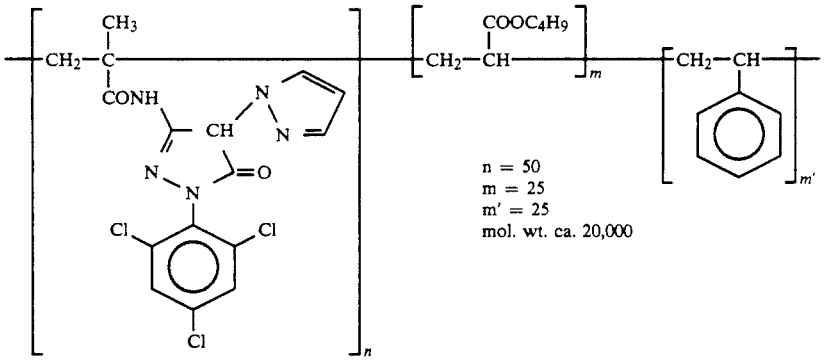
ExM-3
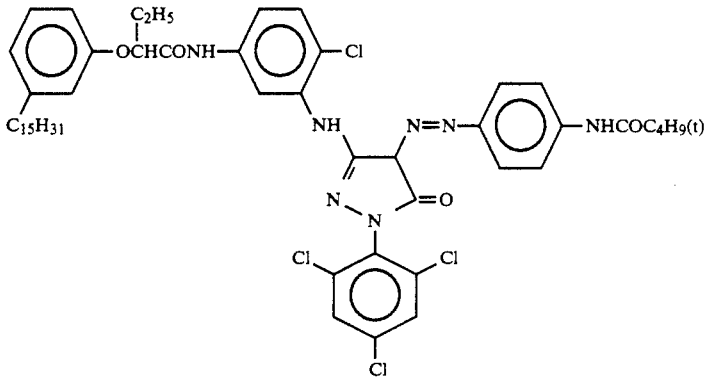

-continued
ExM-4
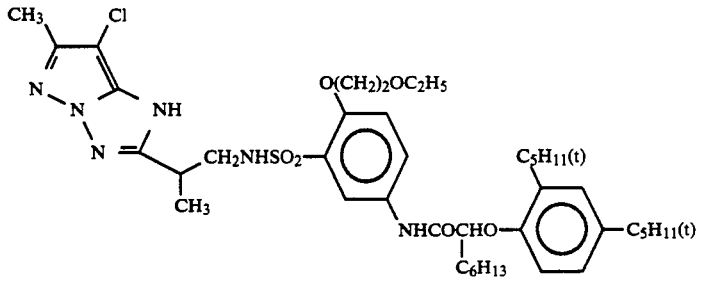
ExM-5
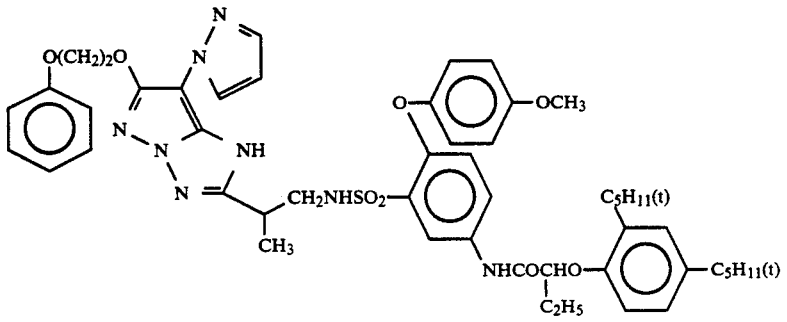
ExY-1
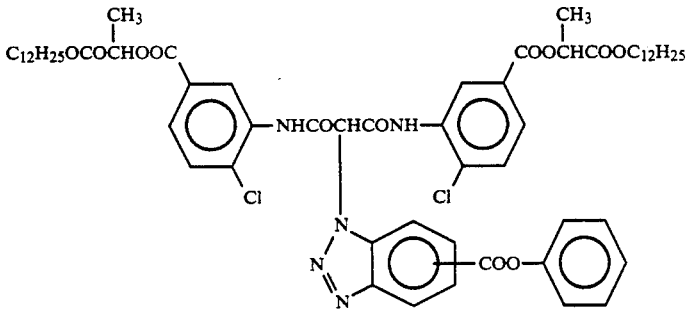
ExY-2
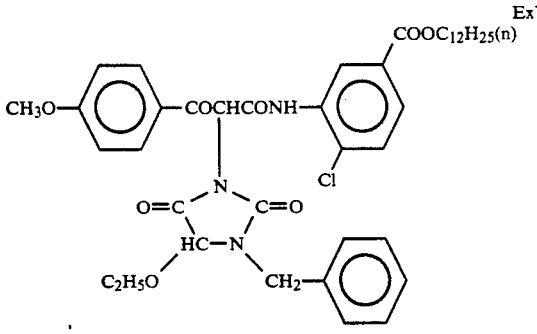
ExY-3
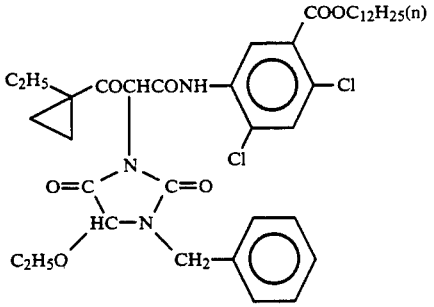
ExY-4
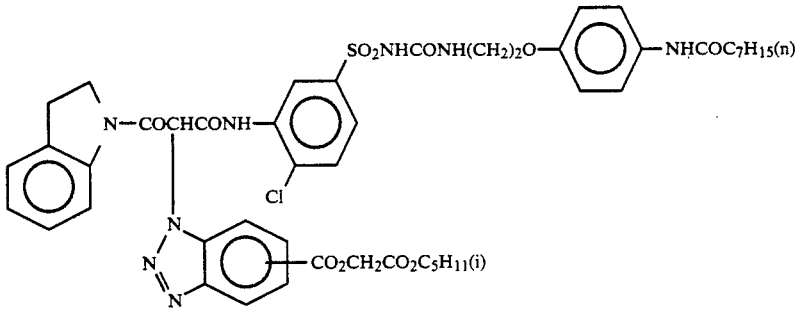

-continued
ExF-1
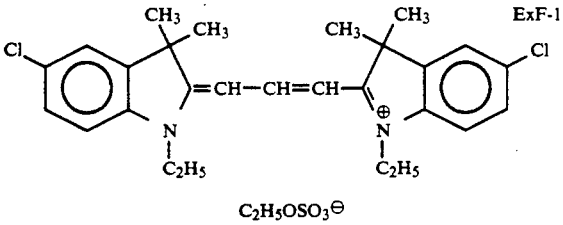
Cpd-1
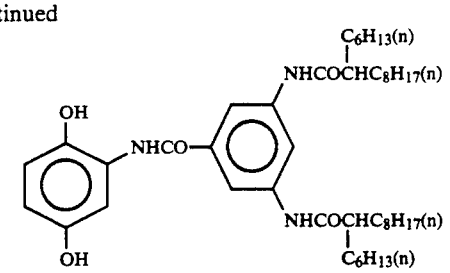
Cpd-2
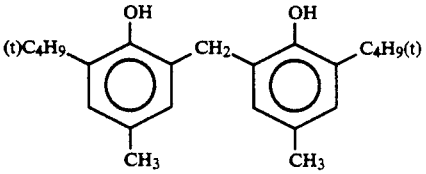
Cpd-3
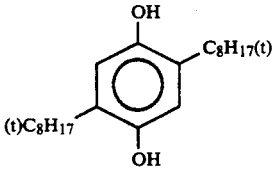
UV-1
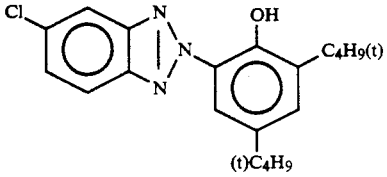
UV-2
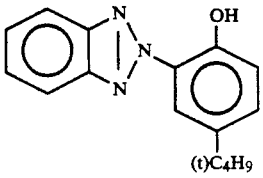
UV-3
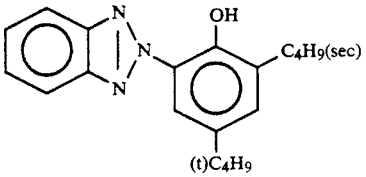
UV-4
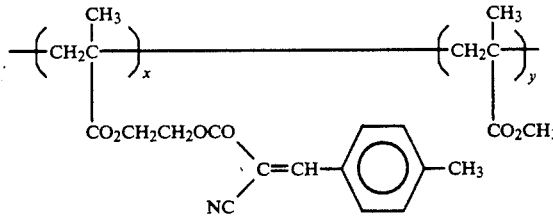
x:y = 70:30 (wt %)
UV-5
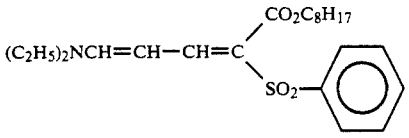
Tricresyl phosphate
HBS-1
Di-n-butyl phthalate
HBS-2
HBS-3
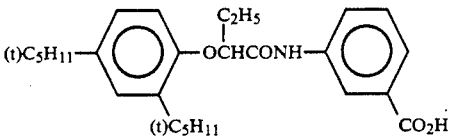
ExS-1
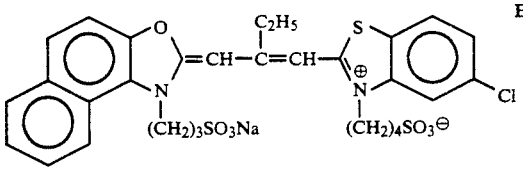
ExS-2
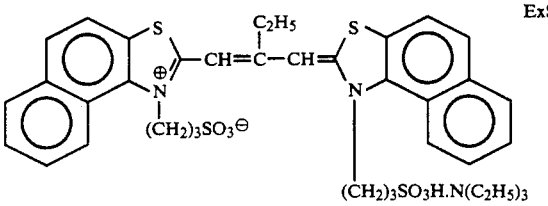
ExS-3
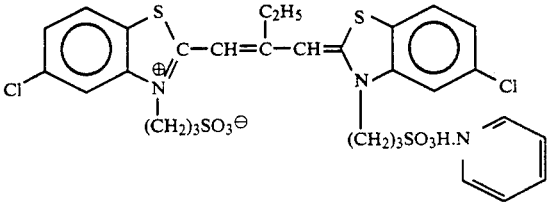

-continued
ExS-4
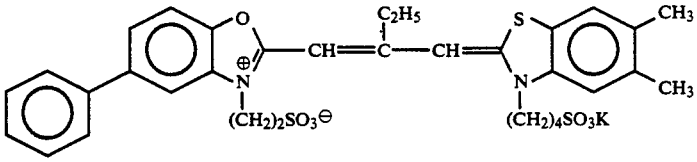
ExS-5
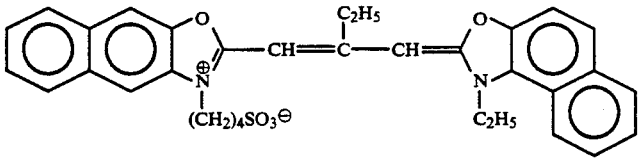
ExS-6
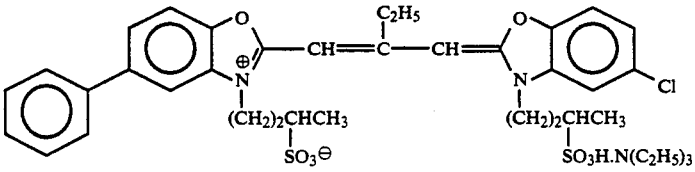
ExS-7
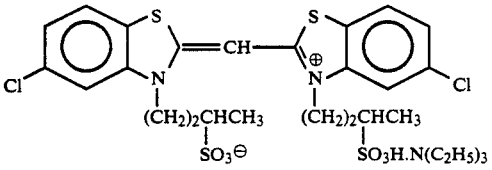
S-1
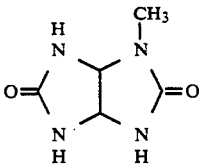
H-1
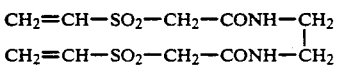
B-1
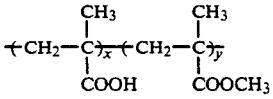
x/y = 10/90
B-2
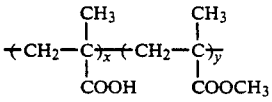
x/y = 40/60
B-3
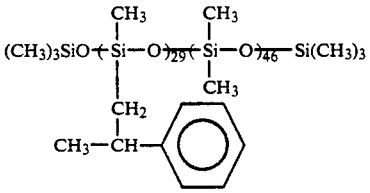
B-4
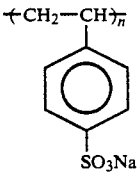
B-5
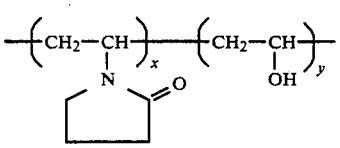
x/y = 70/30
B-6
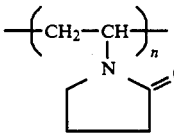
(mol. wt. ca. 10,000)
W-1
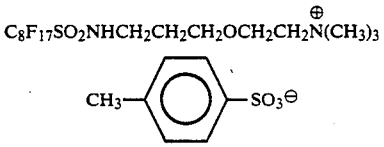
W-2
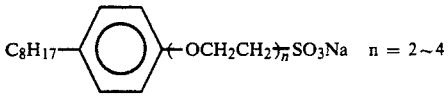
n = 2~4
W-3
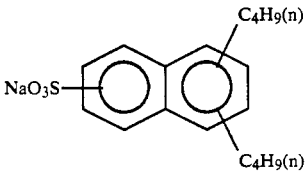

-continued
F-1
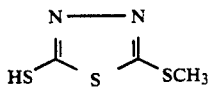
F-2
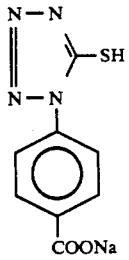
F-3
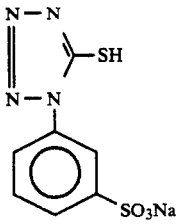
F-4
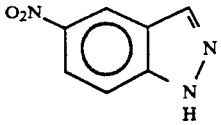
F-5
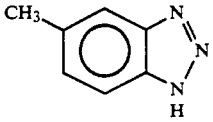
F-6
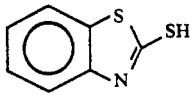
F-7
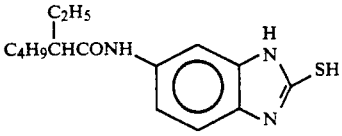
F-8
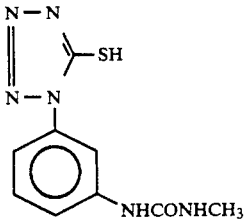
F-9
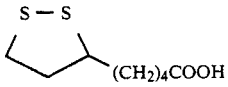
F-10
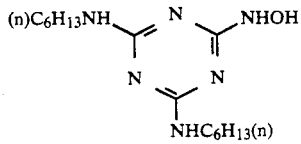
F-11
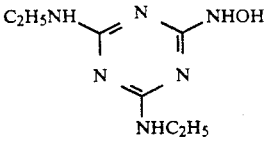
F-12
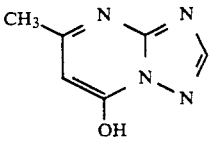
F-13
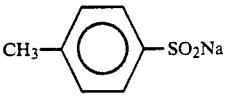
F-14
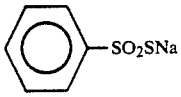
F-15
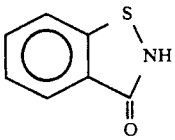
F-16
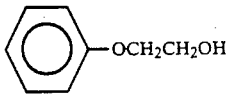
F-17
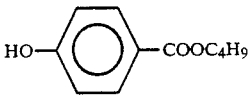

(6) Development

The photographic material samples were developed in accordance with the process described below.

| Color Development Process: | | |
|---|---|---|
| Step | Temperature | Time |
| Color Development | 38° C. | 3 min |
| Stopping | 38° C. | 1 min |
| Rinsing | 38° C. | 1 min |
| Bleaching | 38° C. | 2 min |
| Rinsing | 38° C. | 1 min |
| Fixation | 38° C. | 2 min |
| Rinsing | 38° C. | 1 min |
| Stabilization | 38° C. | 1 min |

Compositions of the processing solutions used above are described below.

| | |
|---|---|
| Color Developer: | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Disodium Ethylenediaminetetraacetate Dihydrate | 2 g |
| 4-Amino-3-methyl-N-ethyl-N-(β-hydroxyethyl)aniline Monosulfate | 4 g |
| Water to make | 1 liter |
| Stopping Solution: | |
| Sodium Thiosulfate | 10 g |
| Ammonium Thiosulfate (70% aqueous solution) | 30 ml |
| Acetic Acid | 30 ml |
| Sodium Acetate | 5 g |
| Potassium Alum | 15 g |
| Water to make | 1 liter |
| Bleaching Solution: | |
| Sodium Ethylenediaminetetraacetate/Iron(III) Dihydrate | 100 g |
| Potassium Bromide | 50 g |
| Ammonium Nitrate | 50 g |
| Boric Acid | 5 g |
| Aqueous Ammonia to make | pH of 5.0 |
| Water to make | 1 liter |
| Fixer: | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 liter |
| Stabilizer: | |
| Boric Acid | 5 g |
| Sodium Citrate | 5 g |
| Sodium Metaborate Tetrahydrate | 3 g |
| Potassium Alum | 15 g |
| Water to make | 1 liter |

The multi-layer color photographic material samples as prepared in the manner described above were examined with respect to the condition of the surface of the photographic layers coated thereon. The results are shown in Tables 1 to 6 above.

From Tables 1 to 6 above, it is understood that the surface flatness of the heat-treated supports of the present invention was good and therefore the photographic material samples having them were free from unevenness of their surfaces coated with the emulsion layers. As opposed to them, the surface flatness of the comparative support samples Nos. 1 to 14 and 15 to 28 in which at least one of the four values defining the thickness pattern was not within the scope of the present invention was bad and therefore the surfaces of the emulsion layers coated on them were uneven.

As explained in detail above, the photographic polyester support of the present invention is heat-treated at a temperature of from 50° C. to the glass transition temperature while it is in the form of a bulk roll. The thus heat-treated support is hardly curled and the surface flatness of the support is not worsened even when rolled up into a roll. In addition, when the support is coated with photographic emulsions, the coated surface is even.

The photographic polyester support of the present invention has higher mechanical strength than TAC. Therefore, the thickness of the support can be reduced significantly. Using the support with such advantages, down-sizing of cameras and film cartridges is possible.

While the invention has been described in detail and with reference to specific embodiments thereof, it will be apparent to one skilled in the art that various changes and modifications can be made therein without departing from the spirit and scope thereof.

What is claimed is:

1. A photographic polyester support which has a thickness pattern having a TD R value, an MD R value, an MD fluctuation and a TD base line value as follows:

(1) TD R value: 8 μm or less (2) MD R value: 10 μm or less (3) MD fluctuation: 8 μm or less (4) TD base line value: 5 μm or less.

2. A photographic polyester support as claimed in claim 1, which has been coated with at least one of a subbing layer and a backing layer.

3. A photographic polyester support as claimed in claim 1, which is made of polyethylene terephthalate or a compound formed therefrom or polyethylene naphthalate or a compound formed therefrom.

4. A photographic polyester support as claimed in claim 1, which is made of a polyester obtained by reacting 2,6-naphthalene-dicarboxylic acid or dimethyl 2,6-naphthalene-dicarboxylate and a glycol consisting essentially of ethylene glycol.

5. A photographic polyester support as claimed in claim 4, which has been biaxially stretched 3.0 to 3.5 times in a lengthwise direction and 2.8 to 4.2 times in a crosswise direction.

6. A photographic polyester support as claimed in claim 1, which has been knurled.

7. A photographic polyester support as claimed in claim 6, in which the knurled thickness is thicker than the mean thickness of the bulk roll by 5 μm to 50 μm.

8. A photographic polyester support as claimed in any of claims 1 to 7, which has a thickness of from 60 μm to 90 μm.

9. A photographic polyester support as claimed in claim 1, which is made of polyethylene naphthalate.

10. A photographic polyester support as claimed in claim 1, wherein the support is a film containing an ultraviolet absorbent.

11. A photographic polyester support as claimed in claim 1, wherein the support is a film which has been treated by a corona-discharging treatment.

12. A photographic polyester support as claimed in claim 2, which is coated with a subbing layer of a hydrophilic binder.

13. A photographic polyester support as claimed in claim 12, which is coated with a subbing layer of gelatin.

* * * * *